US010704746B2

(12) United States Patent
Jeong et al.

(10) Patent No.: US 10,704,746 B2
(45) Date of Patent: Jul. 7, 2020

(54) PORTABLE LIGHTING DEVICES WITH WIRELESS CONNECTIVITY

(71) Applicant: MPOWERD Inc., Brooklyn, NY (US)

(72) Inventors: Seungah Jeong, Brooklyn, NY (US); John Salzinger, Brooklyn, NY (US)

(73) Assignee: MPOWERD Inc., Brooklyn, NY (US)

( * ) Notice: Subject to any disclaimer, the term of this patent is extended or adjusted under 35 U.S.C. 154(b) by 0 days.

(21) Appl. No.: 16/165,864

(22) Filed: Oct. 19, 2018

(65) Prior Publication Data

US 2020/0124240 A1 Apr. 23, 2020

(51) Int. Cl.

| | |
|---|---|
| ***F21V 21/00*** | (2006.01) |
| ***F21L 4/08*** | (2006.01) |
| ***H05B 37/02*** | (2006.01) |
| ***H05B 33/08*** | (2020.01) |
| ***F21V 3/04*** | (2018.01) |
| *F21Y 115/10* | (2016.01) |

(52) U.S. Cl.

CPC ..... *F21L 4/08* (2013.01); *F21V 3/049* (2013.01); *H05B 33/0854* (2013.01); *H05B 33/0863* (2013.01); *H05B 37/0272* (2013.01); *F21Y 2115/10* (2016.08)

(58) Field of Classification Search

CPC ..... F21L 4/08; F21V 3/049; H05B 33/0854; H05B 33/0863; H05B 37/0272

USPC ..... 362/183

See application file for complete search history.

(56) References Cited

U.S. PATENT DOCUMENTS

| | | | |
|---|---|---|---|
| 5,782,552 | A | 7/1998 | Green |
| 5,888,156 | A | 3/1999 | Cmiel |
| 5,947,581 | A | 9/1999 | Schrimmer et al. |
| 6,013,985 | A | 1/2000 | Green et al. |
| 6,193,392 | B1 | 2/2001 | Lodhie |
| 6,897,832 | B2 | 5/2005 | Essig, Jr. et al. |
| 7,073,462 | B1 | 7/2006 | Layman et al. |
| 7,377,667 | B2 | 5/2008 | Richmond |

(Continued)

FOREIGN PATENT DOCUMENTS

| | | |
|---|---|---|
| CA | 152065 | 5/2014 |
| CN | 1162496 A | 10/1997 |

(Continued)

OTHER PUBLICATIONS

Ashan et al. "Solar Powered Lantern for Flood Affected Areas," *Power Engineering Society Winter Meeting*, 2000, pp. 487-492.

(Continued)

*Primary Examiner* — Laura K Tso

(74) *Attorney, Agent, or Firm* — Bookoff McAndrews, PLLC

(57) ABSTRACT

Lighting devices are described and may include a housing that includes one or more end walls and one or more side walls, the housing defining a chamber and a base. The lighting devices may include one or more of a solar panel, a rechargeable battery, a microprocessor, a wireless interface, and/or a plurality of lights, in communication with one another. The plurality of lights may be configured to emit light transverse to the one or more side walls, the lighting device also including a diffuser configured to diffuse and redirect light emitted by the plurality of lights into the chamber. The microprocessor may be configured to control at least one operating mode of the plurality of lights.

19 Claims, 16 Drawing Sheets

(56) References Cited

U.S. PATENT DOCUMENTS

| | | | | |
|---|---|---|---|---|
| 7,497,583 | B2 * | 3/2009 | Ma | A45B 3/04 135/16 |
| 7,513,638 | B2 | 4/2009 | Allsop et al. | |
| 7,690,812 | B2 | 4/2010 | Roberts | |
| 7,753,576 | B2 | 7/2010 | Marcinkewicz et al. | |
| 7,825,325 | B2 | 11/2010 | Kennedy et al. | |
| 7,857,490 | B1 | 12/2010 | Fett | |
| 8,410,748 | B2 | 4/2013 | Wilson | |
| 8,674,211 | B1 | 3/2014 | Palmer et al. | |
| 8,823,315 | B2 | 9/2014 | Oppizzi | |
| 8,845,126 | B1 | 9/2014 | Martzall | |
| 9,016,886 | B2 | 4/2015 | Snyder | |
| 9,080,736 | B1 * | 7/2015 | Salzinger | H05B 37/0218 |
| 9,194,563 | B2 | 11/2015 | Synder | |
| 9,200,767 | B2 | 12/2015 | Katsaros | |
| 9,200,770 | B2 | 12/2015 | Chun | |
| 9,206,952 | B2 | 12/2015 | Gold et al. | |
| 9,255,675 | B1 | 2/2016 | Salzinger et al. | |
| 9,347,629 | B2 | 5/2016 | Stork et al. | |
| 9,638,399 | B2 | 5/2017 | Synder | |
| 10,180,221 | B1 * | 1/2019 | Jeong | F21L 4/08 |
| 2004/0130888 | A1 | 7/2004 | Twardawski | |
| 2005/0002188 | A1 | 1/2005 | Bucher et al. | |
| 2005/0265029 | A1 | 12/2005 | Epstein et al. | |
| 2006/0022635 | A1 | 2/2006 | Cheung et al. | |
| 2006/0108612 | A1 | 5/2006 | Richmond | |
| 2006/0291217 | A1 | 12/2006 | Vanderschuit | |
| 2007/0014125 | A1 | 1/2007 | Chu | |
| 2007/0091594 | A1 | 4/2007 | Soon | |
| 2008/0013317 | A1 | 1/2008 | Hinds | |
| 2008/0175006 | A1 | 7/2008 | Kellmann et al. | |
| 2008/0225553 | A1 | 9/2008 | Roberts et al. | |
| 2009/0251892 | A1 * | 10/2009 | Hatti | F21S 9/037 362/183 |
| 2010/0110668 | A1 * | 5/2010 | Marlonia | F21V 21/15 362/152 |
| 2010/0214774 | A1 | 8/2010 | Liu et al. | |
| 2011/0018439 | A1 | 1/2011 | Fabbri | |
| 2011/0133655 | A1 | 6/2011 | Recker et al. | |
| 2011/0216529 | A1 | 9/2011 | Weng | |
| 2012/0042996 | A1 | 2/2012 | Glynn | |
| 2012/0120642 | A1 | 5/2012 | Sreshta et al. | |
| 2012/0152306 | A1 | 6/2012 | Iqbal et al. | |
| 2012/0193660 | A1 | 8/2012 | Donofrio | |
| 2012/0224359 | A1 | 9/2012 | Chun | |
| 2012/0242247 | A1 | 9/2012 | Hartmann et al. | |
| 2012/0300444 | A1 | 11/2012 | Gibson et al. | |
| 2013/0201668 | A1 * | 8/2013 | Chien | F21V 3/02 362/183 |
| 2013/0335953 | A1 | 12/2013 | Gold et al. | |
| 2014/0049942 | A1 | 2/2014 | Chilton et al. | |
| 2014/0118997 | A1 * | 5/2014 | Snyder | F21S 9/037 362/183 |
| 2014/0146525 | A1 | 5/2014 | Lueptow | |
| 2015/0036325 | A1 | 2/2015 | Cohen | |
| 2015/0219294 | A1 | 8/2015 | Sreshta et al. | |
| 2015/0338033 | A1 * | 11/2015 | Lin | F21V 13/04 362/1 |
| 2016/0025287 | A1 * | 1/2016 | Philhower | F21S 9/037 362/183 |
| 2016/0040836 | A1 | 2/2016 | Sreshta et al. | |
| 2016/0109077 | A1 | 4/2016 | Chun | |
| 2016/0154171 | A1 * | 6/2016 | Kato | F21V 29/508 362/606 |
| 2016/0215941 | A1 | 7/2016 | Salzinger et al. | |
| 2016/0341380 | A1 | 11/2016 | Stork et al. | |
| 2017/0234493 | A1 | 8/2017 | Stork et al. | |
| 2017/0276303 | A1 | 9/2017 | Chen | |
| 2018/0048949 | A1 | 2/2018 | Chen | |
| 2018/0128438 | A1 | 5/2018 | Sreshta et al. | |

FOREIGN PATENT DOCUMENTS

| | | | |
|---|---|---|---|
| CN | 101576204 | A | 11/2009 |
| CN | 101690402 | A | 3/2010 |
| CN | 201582579 | U | 9/2010 |
| CN | 101886746 | A | 11/2010 |
| CN | 201706338 | U | 1/2011 |
| CN | 201715273 | U | 1/2011 |
| CN | 102116415 | A | 7/2011 |
| CN | 202048488 | U | 11/2011 |
| CN | 202109228 | U | 1/2012 |
| CN | 102379502 | A | 3/2012 |
| CN | 102403929 | A | 4/2012 |
| CN | 202203682 | U | 4/2012 |
| CN | 102592522 | A | 7/2012 |
| CN | 102668697 | A | 9/2012 |
| CN | 202469530 | U | 10/2012 |
| CN | 202511013 | U | 10/2012 |
| CN | 202581071 | U | 12/2012 |
| CN | 202884514 | U | 4/2013 |
| CN | 203215307 | U | 9/2013 |
| CN | 203489018 | U | 3/2014 |
| CN | 302782955 | S | 3/2014 |
| CN | 204201750 | U | 3/2015 |
| CN | 204420848 | U | 6/2015 |
| CN | 205624968 | U | 10/2016 |
| CN | 205640672 | U | 10/2016 |
| CN | 206042307 | U | 3/2017 |
| DE | 102006022185 | | 11/2007 |
| EP | 002289363-0001 | | 8/2013 |
| KR | 101061738 | B1 | 6/2011 |
| WO | WO 95/33624 | A1 | 12/1995 |
| WO | WO 2004/071935 | A2 | 8/2004 |

OTHER PUBLICATIONS

GirlmeetsGeek, "Luci Aura :. MPOWERD's Solar Lantern Gives Back and Means It," Jan. 24, 2014, available at http://www.girlmeetsgeek.com/2014/01/24/luci-aura-mpowerds-solar-lantern-means/.

Goering, L., "Blow-up Solar Lantern Lights up Haiti's Prospects," Thomson Reuters Foundation, Jun. 22, 2012 (4 pages), available at http://www.trust.org/item/20120622150100-k9yos.

Jonsson, J. Project Soul Cell, YouTube, Oct. 28, 2009 (1 page), available at http://www.youtube.com/watch?v=DG7lkgUUr4M.

Lemke, E., "Inflatable Lantern Provides Big Light," Feb. 20, 2015, available at https://gearjunkie.com/luminaid-packlite-lantern.

Liszewski, A., "The Luci Inflatable Solar Lantern Gets a Colorful Follow-up," Jan. 8, 2014, available at https://gizmodo.com/the-luci-inflatable-solar-lantern-gets-a-colorful-follo-1496922502.

"Luci® Aura, MPOWERD's Color Changing Solar Lantern Joins Infatable Luci® Center Stage at ShowStoppers @ CES 2014," Jan. 7, 2014, available at https://www.prnewswire.com/news-releases/luci-aura-mpowerds-color-changing-solar-lantern-joins-inflatable-luci-center-stage-at-showstoppers--ces-2014-239076741.html.

MPOWERD™ Good Energy™ presentation, Apr. 2, 2014 (23 pages).

MPOWERD Luci Connect information cards, Oct. 2018 (4 pages).

MPOWERD Solar String Lights & Luci Connect poster, Oct. 2018 (1 page).

MPOWERD, "Technical Specifications: Luci & Luci Aura," Apr. 3, 2014 (1 page).

MPOWERD 2015 Winter Catalog, "MPOWERD™ Anytime. Anywhere. Any weather™," Jan. 15, 2015 (32 pages).

Patent Evaluation Report for Chinese Application No. ZL201320570977.8, dated Feb. 26, 2014 (87 pages).

* cited by examiner

PORTABLE LIGHTING DEVICES WITH WIRELESS CONNECTIVITY

TECHNICAL FIELD

The present disclosure generally relates to portable lighting devices. More particularly, the present disclosure includes portable, rechargeable lighting devices that have wireless connectivity.

BACKGROUND

Portable lighting devices have uses in a variety of situations, including situations of limited or no power access and situations where power access would be inconvenient or cumbersome. Controlling such devices can be inconvenient or not possible in some cases, e.g., if a user does not have immediate access to a power button, or if the user prefers more options than off/on functionality. There is a need for improved structural and functional features of portable lighting devices.

SUMMARY OF THE DISCLOSURE

The present disclosure includes lighting devices, including, e.g., solar-powered lighting devices with various operating modes of lights housed within the device, optionally with wireless communication features for controlling the lights and/or other electronic components of the device. The lighting device, according to some examples herein, may include: a housing including one or more end walls and one or more side walls, the housing defining a chamber and a base; at least one solar panel; at least one rechargeable battery in communication with the solar panel; a microprocessor in communication with the solar panel and the rechargeable battery; a plurality of lights disposed outside the chamber along an inner surface of the one or more side walls and configured to emit light in a direction transverse to the one or more side walls, the plurality of lights being in communication with the solar panel, the rechargeable battery, and the microprocessor; and a diffuser radially inward of the plurality of lights, the diffuser being configured to diffuse and redirect light emitted by the plurality of lights into the chamber; wherein the microprocessor is configured to control at least one operating mode of the plurality of lights.

Additionally or alternatively, the lighting device, according to some examples, may include: a housing including one or more end walls and one or more side walls, the housing defining a chamber and a base; a plurality of light-emitting diode (LED) lights, wherein the plurality of LED lights comprises RGB LED lights; and an electronic assembly comprising: at least one solar panel; at least one rechargeable battery in communication with the solar panel; a microprocessor in communication with the solar panel and the rechargeable battery; and a wireless interface configured to receive user input wirelessly from an external electronic device. The microprocessor may be configured to control at least one operating mode of the plurality of lights based on user input received from the external electronic device through the wireless connection, and the at least one operating mode includes changing a color of light that illuminates the chamber by selecting red, green, and blue values from 0 to 255 for each RGB LED light of the plurality of lights.

Further, in some examples, the lighting device may include: a cylindrical housing including two end walls and a side wall between the two end walls, the housing defining a chamber and a base; a plurality of light-emitting diode (LED) lights disposed along an inner surface of the base and configured to emit light radially inward in a direction transverse to the side wall, the plurality of LED lights including white LED lights and RGB LED lights; a diffuser radially inward of the plurality of LED lights, the diffuser being configured to diffuse light emitted by the plurality of LED lights into the chamber; and an electronic assembly comprising: at least one solar panel; at least one rechargeable battery in communication with the solar panel; a wireless interface configured to receive user input wirelessly from an external electronic device; and a microprocessor in communication with the solar panel, the rechargeable battery, and the wireless interface. The microprocessor may be configured to control at least one operating mode of the plurality of LED lights, including changing a color of light that illuminates the chamber by selecting red, green, and blue values from 0 to 255 for each color coordinate for each RGB LED light of the plurality of lights.

According to some aspects of the present disclosure, the diffuser defines a plurality of recesses along an outer periphery of the diffuser, and each light of the plurality of lights (e.g., LEDs, such as white LEDs and/or color (RGB) LEDs) is accommodated within a respective recess of the plurality of recesses of the diffuser. In some examples, the plurality of lights are coupled to a support, and optionally disposed at regular intervals along the support. The plurality of lights may be disposed outside the chamber, e.g., along an inner surface of the one or more side walls and configured to emit light in a direction transverse to the one or more side walls, the plurality of lights being in communication with the solar panel, the rechargeable battery, and the microprocessor.

In some examples herein, the total number of lights ranges from 2 lights to 50 or more lights, such as, e.g., 6 to 48 lights, 10 to 30 lights, or 12 to 24 lights. In cases in which the lights include white lights and RGB lights, the number of white lights may be the same or different than the RGB lights. For example, the ratio of the ratio of white lights to RGB lights (white lights:RGB lights) may range from 1:20 to 20:1, e.g., a ratio of 1:1, 2:1, 1:2, 3:1, 1:3, etc. The white lights optionally may be controlled independently of the RGB lights and/or the color of each RGB light may be controlled independently of one or more other RGB lights.

According to some aspects of the present disclosure, the plurality of LED lights comprises a plurality of white LED lights and a plurality of RGB LED lights, and the at least one operating mode includes changing the color of light that illuminates the chamber by selecting red, green, and blue values from 0 to 255 for each RGB LED light of the plurality of lights while the white LED lights are off. Such operating modes may be controlled, for example, based on user input received from a user element, such as a button, and/or an external electronic device through a wireless connection of the lighting device.

Further, the chamber of the lighting devices herein may be wherein the chamber is collapsible and inflatable, the chamber including a valve for inflating and deflating the chamber. In other examples, one or more walls defining the chamber may be rigid. Thus, in some examples, the chamber is not inflatable and/or is not collapsible. According to some aspects of the present disclosure, the base of the lighting device is selectively detachable and re-attachable from the chamber, e.g., via complementary mating elements of the base and the chamber.

Any of the foregoing features of lighting devices may be used in combination with each other in yet additional examples as discussed further herein.

BRIEF DESCRIPTION OF THE DRAWINGS

The accompanying drawings, which are incorporated in and constitute a part of this specification, illustrate various exemplary embodiments and together with the description, serve to explain the principles of the present disclosure.

DETAILED DESCRIPTION

The terminology used in this disclosure may be interpreted in its broadest reasonable manner, even though it is being used in conjunction with a detailed description of certain specific examples of the present disclosure. Both the foregoing general description and the following detailed description are exemplary and explanatory only and are not restrictive of the features, as claimed.

The term "one or more of," when preceding a list of items defined using the conjunction "and," denotes an alternative expression that may be satisfied by a single item in the list or a combination of items in the list. The term "or" is meant to be inclusive and means either, any, several, or all of the listed items. Relative terms, such as "about" and "generally," are used to indicate a possible variation of ±5% of a stated or understood value. The singular forms "a," "an," and "the" include plural referents unless the context dictates otherwise.

The terms "comprises," "comprising," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. The term "exemplary" is used in the sense of "example" rather than "ideal."

Exemplary lighting devices of the present disclosure may comprise a housing that includes a chamber and a base, wherein the chamber is optionally collapsible (e.g., inflatable). The lighting device may have any suitable shape or configuration. While exemplary lighting devices shown in the figures are generally cylindrical in shape, other configurations and shapes are encompassed herein. Thus, for example, the housing may be square, rectangular, star-shaped, spherical, oval, other polygonal, etc. In some examples, the chamber is collapsible, e.g., including one or more side walls configured to fold or otherwise collapse. For example, the chamber may be inflatable as further discussed below. In some examples, the housing is not inflatable or collapsible, e.g., the one or more side walls defining the chamber being rigid.

Figure 1A:
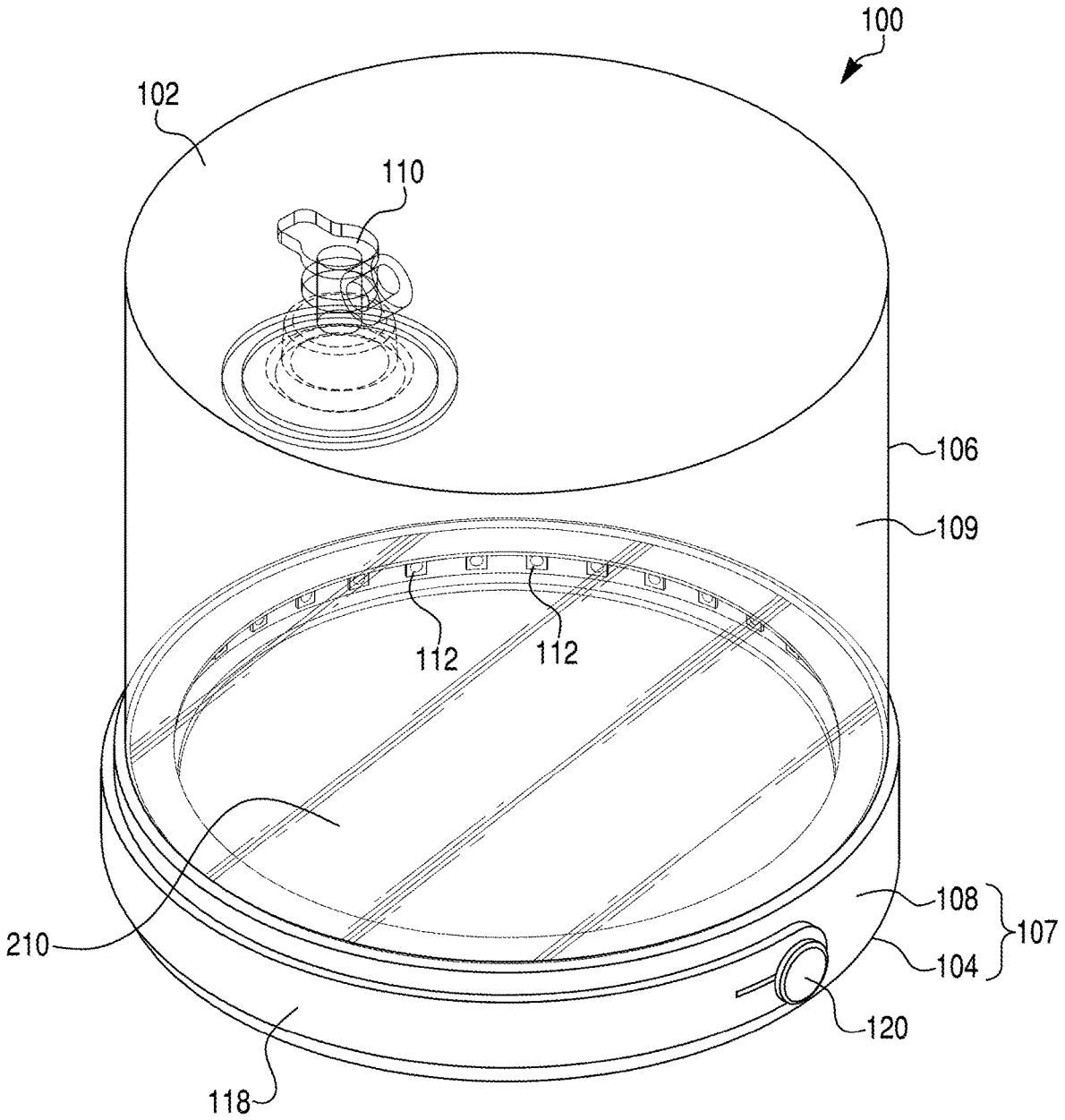
FIGS. 1A and 1B are perspective views of a lighting device, according to one or more embodiments.
Figure 1B:
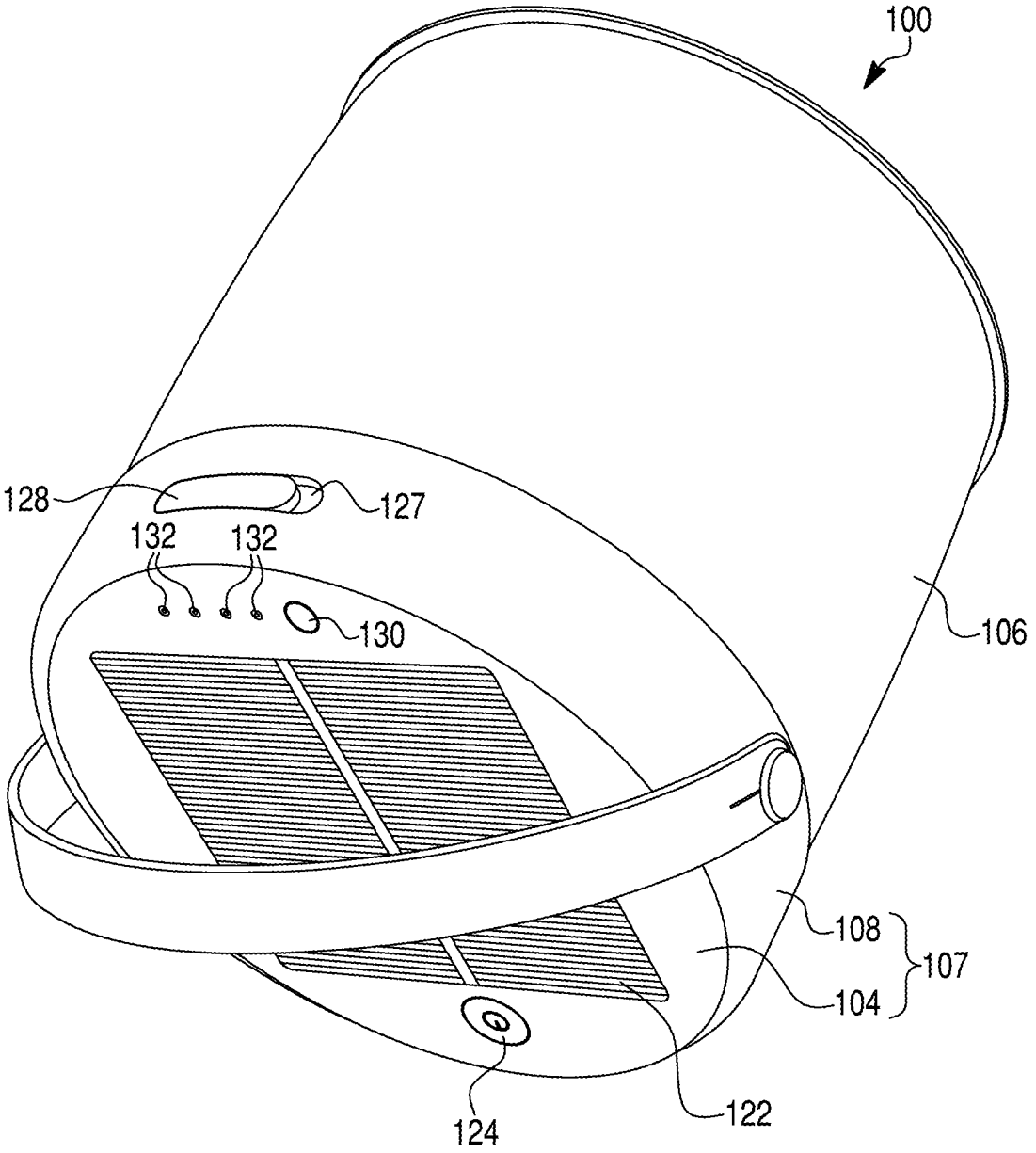

FIGS. 1A and 1B are perspective views of an exemplary lighting device 100. The lighting device 100 comprises a housing that includes a chamber 109 and a base 107. In the example shown in FIGS. 1A and 1B, the housing comprises a first wall 102, a second wall 104 opposite to the first wall 102, a first inner panel 210 between the first wall 102 and the second wall 104 (see FIG. 2A), and a first side wall 106 between the first wall 102 and the first inner panel 210. The chamber 109 of the housing is defined by the first wall 102, the first side wall 106, and the first inner panel 210. The base 107 is coupled to the chamber 109 and includes the second wall 104. The housing of the lighting device or a portion thereof (e.g., chamber 109 and/or base 107) may be airtight and/or watertight. For example, the housing or a portion thereof may have an IPX4 or IPX7 waterproof rating. In some examples, the chamber 109 is collapsible, e.g., the first side wall 106 being configured to fold or otherwise collapse such that the first wall 102 is adjacent to, e.g., lies flat against, the first inner panel 210. For example, the first side wall 106 of the chamber 109 may comprise a flexible plastic or other polymer material. Other materials may be used, such as textiles (e.g., a translucent woven material). In some examples, the chamber 109 is inflatable as further discussed below. In other examples, the housing is not inflatable or collapsible, e.g., the side wall 106 being rigid.

The housing of the lighting device 100 may have an overall cylindrical shape as shown in FIGS. 1A and 1B, although other shapes are contemplated and encompassed herein as mentioned above. Thus, for example, the first wall 102, the first inner panel 210, and the second wall 104 are shown as being generally circular in cross-section. However, the first wall 102, the first inner panel 210, and the second wall 104 may have other shapes (e.g., oval, square, rectangular, triangular, hexagonal, star-shaped, other polygonal cross-sections, etc.) providing for a housing that is non-cylindrical. Additionally, while the first wall 102 and the second wall 104 are depicted as being flat in the example lighting device 100 shown in the figures, the first wall 102 and/or the second wall 104 may have other shapes or forms, such as a dome-shaped form. The base 107 may include the second wall 104 and at least one side wall, e.g., second side wall 108. The base 107 may enclose one or more electronic components of the lighting device 100 as further discussed below.

In some examples, the lighting device 100 may include at least one handle. For example, the handle may be coupled to the base 107 and configured to pivot relative to the base 107. In the example of FIG. 1B, the base 107 includes two pivot points, e.g., locking knobs 120, on opposite sides of the base 107 (e.g., coupled to, or integral with, portions of the second side wall 108 located 180 degrees apart). The locking knobs 120 may be coupled to and support ends of a strap 118, such that the strap 118 is pivotable relative to the base 107 about the locking knobs 120, as shown in FIG. 1B. The strap 118 may be rigid, semi-rigid, or flexible. For example, the strap 118 may comprise silicone or other flexible polymer, or the strap may comprise a rigid polymer. Further, the handle may include portions that are flexible and portions that are rigid. The lighting device 100, in various configurations, may be portable. Portability of the lighting device 100 may be facilitated by the strap 118 of the handle, permitting the lighting device 100 to be carried by the handle. When the handle is in the position shown in FIG. 1A, such that the strap 118 is against the second side wall 108, the lighting device 100 may be capable of sitting flat against a surface (when the second wall 104 is flat).

The knobs 120 may be integrally formed with, or coupled to, the second side wall 108. Additionally or alternatively, the second side wall 108 and the second wall 104 may be integrally formed with each other. In some examples, the second wall 104, the second side wall 108, and the knobs 120 may each be respective portions of a single unitary, one-piece member of continuous material serving as the base 107 or part of the base 107. Alternatively, in some examples, the second side wall 108, the second wall 104, and/or the knobs 120 may be separately formed members that are coupled together, e.g., attached or directly connected to one another. The base 107 and any of its substituent portions discussed above may comprise a plastic material or other polymer. In some examples, the base 107 (e.g., second side wall 108 and/or second wall 104) comprises a rigid polymer material, such as acrylonitrile butadiene styrene (ABS).

In various embodiments, the chamber 109 of the lighting device 100 may be inflatable, e.g., wherein the first side wall 106 may be collapsible. For example, the first side wall 106 may comprise a flexible polymer, such as polyvinyl chloride (PVC). When the first side wall 106 is collapsed, the volume of the chamber 109 defined by the first wall 102 and the first side wall 106 may be substantially reduced, e.g., such that the first wall 102 is adjacent to the first inner panel 210. The housing of the lighting device 100 may include a valve to allow for inflating and deflating the chamber. As shown in FIGS. 1A and 1B, for example, the first wall 102 may include a valve 110. Any suitable type of valve may be used. The chamber 109 and the first side wall 106 may be expanded from a collapsed state into the inflated state that is shown in FIG. 1A by inflating the chamber 109 with air provided through valve 110. Once inflated, the chamber 109 may be returned to the collapsed state by deflating the chamber 109 through the valve 110. The valve 110 may be sealable, so as to allow a user to inflate and deflate the lighting device 110 whenever desired, and to seal the chamber 109 such that the chamber 109 is airtight and/or watertight. It is noted, however, that collapsibility is not required. In other configurations, the first side wall 106 may be rigid and non-collapsible, in which case the valve 110 may be omitted.

The lighting device 100 includes one or more light sources, which may be configured to generate any combination of white light and/or various colors of visible light (e.g., red, orange, yellow, green, blue, violet, and/or combinations thereof, e.g., pink, aqua, etc.). Additionally or alternatively, the light sources may be configured to generate infrared light, and/or ultraviolet light (e.g., UV-A, UV-B, and/or UV-C). The one or more light sources may take the form of a plurality of lights 112 arrayed along an interior surface of the lighting device 100 so as to be facing radially inward. The lights 112 may be light-emitting diodes (LED) lights. In some examples, the plurality of lights 112 comprises white LEDs, RGB LEDs, or a combination thereof.

As shown in FIG. 1B, the lighting device 100 may include one or more solar panels 122 that may be used to power the lights 112 directly and/or to recharge a battery (rechargeable battery 214 of FIG. 2A) that powers the lights 112. The solar panel 122 may, for example, comprise silicon, e.g., monocrystalline or polycrystalline silicon.

The first wall 102, the first inner panel 210, and the first side wall 106 each may be at least partially transparent or translucent, such that light generated by the lights 112 passes therethrough to illuminate the chamber 109 and shine light outside the chamber 109. For simplicity, valve 110 is not shown in FIG. 1B, although it may be visible in such a view depending on the transparency of the first wall 102 and the first side wall 106. In some examples, one or more of the first wall 102, the first inner panel 210, and/or the first side wall 106 may be translucent with a frosted appearance. Additionally or alternatively, the material(s) forming the first wall 102, the first inner panel 210, and/or the first side wall 106 may be colored and/or include a design, such that light emitted from the chamber 109 is colored and/or forms a design. Exemplary designs may include, for example, text and/or image(s), which may relate to a holiday, a birthday, a corporate logo, stars, constellations, cartoon characters, sports, sports teams, etc. In at least one example, the first wall 102 and/or the first side wall 106 comprises a matte or frosted plastic material (such as matte or frosted PVC), so that light emitted by the chamber 109 becomes blurred, in the manner of a lampshade. When the first side wall 106 is formed to be collapsible, the material(s) forming the first side wall 106 may be flexible, to allow the first side wall 106 to be foldable/collapsible.

In some examples, the first side wall 106 may be seamless. Additionally or alternatively, the first wall 102 and the first side wall 106 may be integrally formed with one another such that they are respective portions of a single unitary, one-piece member of continuous material. In some examples, the first wall 102 and the first side wall 106 may be separately formed members that are attached or directly connected to one another. The first wall 102 and the first side wall 106 may collectively function as a light cover.

The lighting device 100 may include a plurality of user elements or interfaces, such as buttons, switches, dials, touchscreens, etc., used to accept user input in order to perform various functionalities. As shown in FIG. 1B, the second wall 104 of the lighting device 100 may include first and second user elements, e.g., first button 124 and second button 130. The first button 124 and the second button 130 each may comprise a polymer, such as ABS plastic, overlaying electronic components, and may have the same or different color as that of the second wall 104 and/or other portions of the base 107.

The first button 124 may be used to turn the device 100 on and off (selectively provide and terminate power to the light sources and/or other electronic components of the lighting device 100). The first button 124 optionally may control additional functionalities (e.g., operating modes) of the lighting device 100, such as changing between various modes of the lights 112. Example functionalities and operating modes are further discussed below.

The second button 130 may be used to provide an indication of the amount of power remaining in the device 100. For example, the second button 130, when pressed, may activate a battery indicator in the form of a plurality of indicator lights 132 that indicate the amount of battery charge (e.g., the charge of battery 214, see FIG. 2A). The amount of battery charge may be indicated by the number of indicator lights 132 that light up when the second button 130 is pressed. For example, the greater the battery charge, the more indicator lights 132 may be lit when the second button 130 is pressed. The correspondence between the number of indicator lights 132 and the battery charge may include specified ranges or thresholds of the battery charge (e.g., 100% charge corresponds to 4 indicator lights 132 illuminated, 75% charge corresponds to 3 indicator lights illuminated and 1 indicator light 132 not illuminated, etc.).

Furthermore, the lighting device 106 may include one or more electronic ports 127. The electronic port(s) 127 may allow for connecting the lighting device 100 to various electronic devices, e.g., to provide power to an electronic device and/or to accept power to charge the battery. The electronic port(s) 127 may be a universal serial bus (USB) type port, such as a USB 2.0, USB 3.0, or USB-C port, or other types of electronic connections, such as micro-USB or Lighting (e.g., for devices manufactured by Apple Inc.). The electronic port(s) 127 may be continuously accessible or may be covered by a port cover 128, such that a user may move the port cover 128 in order to access each port 127 for charging the battery 214 and/or data or power transfer. For example, the electronic port(s) 127 may provide the ability to charge the battery of a portable device, such as a smartphone.

Figure 2A:
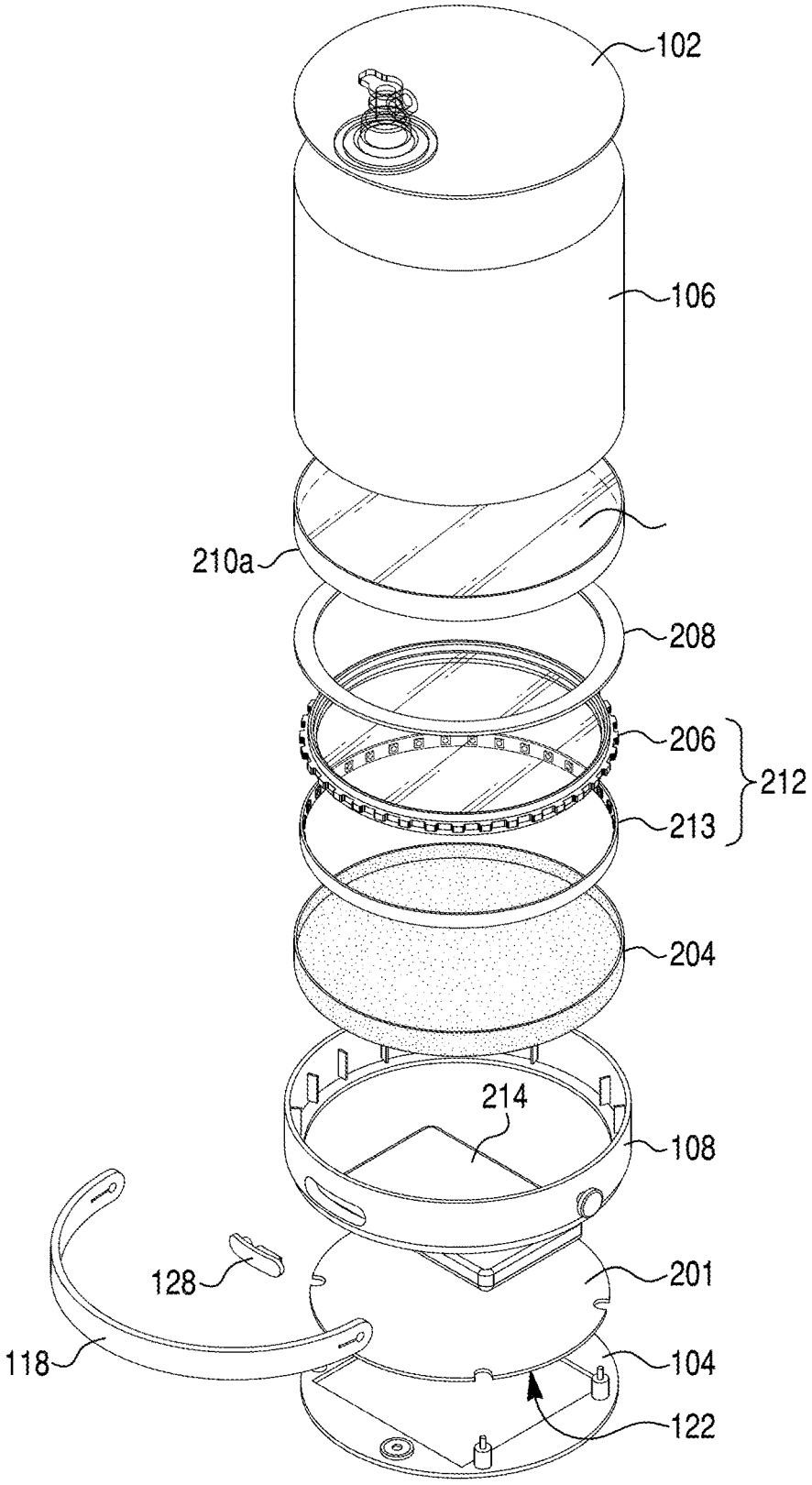
FIGS. 2A and 2B are exploded views of a lighting device, according to one or more embodiments.
Figure 2B:
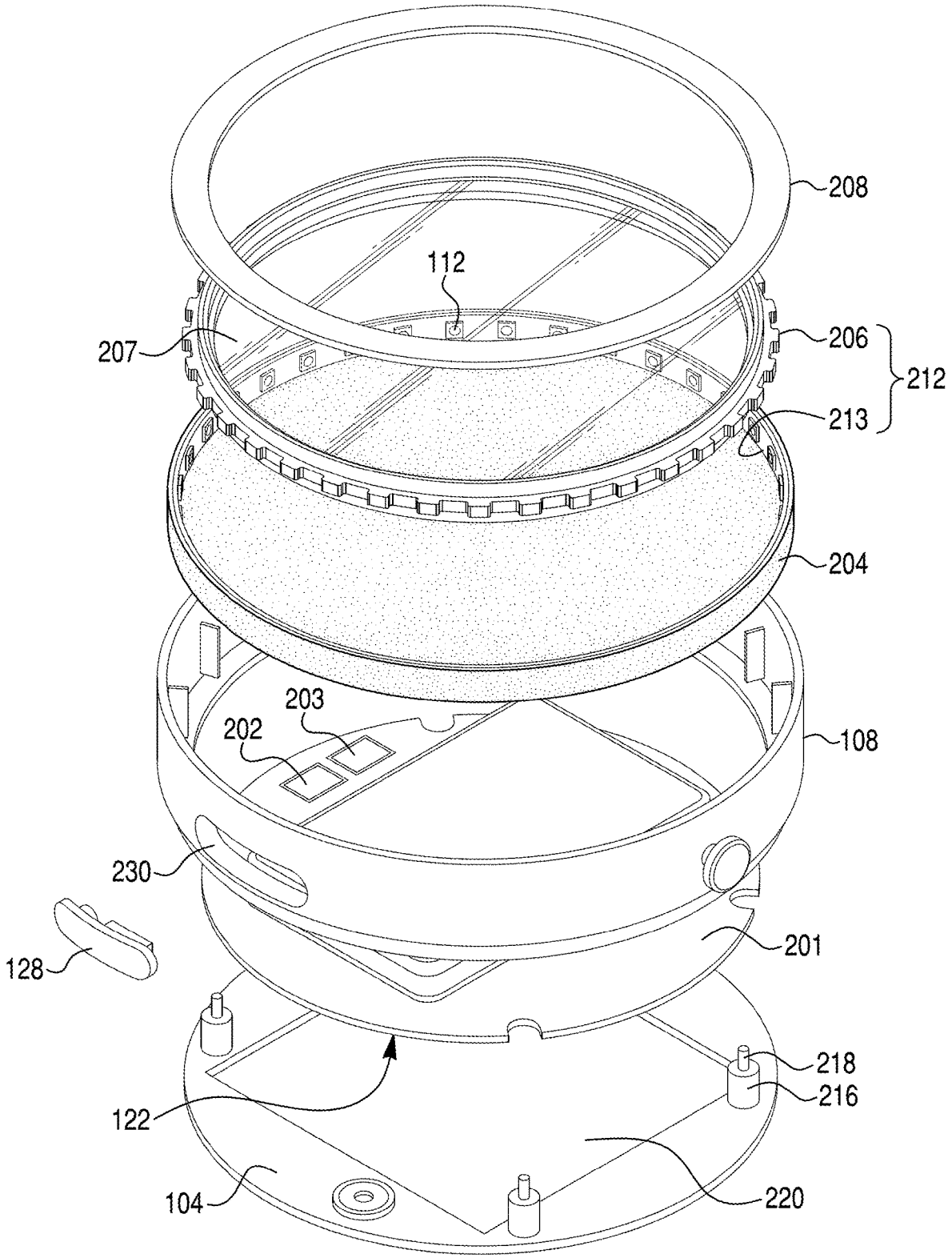

FIGS. 2A and 2B show exploded views of the lighting device 100, showing additional features of the lighting device 100. As shown in FIGS. 2A and 2B, the first inner panel 210 separates the chamber 109 from the plurality of lights 112 and electronic components housed within the base 107. In some examples, the first inner panel 210 provides a seal with the base 107 and/or the first side wall 106, to separate fluids (e.g., water or air) from the lights 112 and other electronic components enclosed within the base 107. Any suitable connection capable of making a seal may be used. For example, the first inner panel 210 may have a lip 210*a* protruding upward or downward; this lip 210*a* may serve the purpose of effectuating the seal. As mentioned above, the first inner panel 210 may be at least partially transparent or translucent, so that light generated by the lights 112 may pass therethrough into the chamber 109. Thus, for example, the first inner panel 210 may comprise a transparent or translucent plastic material, such as clear PVC.

The lights 112 may form part of a light assembly 212 disposed between the first inner panel 210 and the base 107. The light assembly 212 may include a support 213 to which the lights 112 are coupled and a light diffuser 206. The light diffuser 206 may take the form of a panel 207 with a plurality of recesses disposed along the perimeter, wherein each recess can receive one of the lights 112. In order to help direct the light generated by the plurality of lights 112 to the chamber 109, the light diffuser 206 may be disposed radially inward of the support 213 and the lights 112. Thus the lights 112 may face radially inward, such that the light generated by the lights 112 passes through the diffuser 206. The light assembly 212 may be disposed between a cover 208 and a second inner panel 204 (see FIG. 2A).

Rather than facing in a direction perpendicular to the first inner panel 210 towards the center of the chamber 109, the plurality of lights may be face in a direction parallel to the first inner panel, as mentioned above. The diffuser 206 may be configured to diffuse the light generated by the plurality of lights 112 so as to illuminate the chamber. Thus, for example, light generated by the plurality of lights 112 may collectively appear more uniform, even when the lights 112 are implemented as a plurality of individual light sources spaced apart from one another as shown (see, e.g., FIGS. 2A and 2B). The diffuser 206 may be positioned so that the plurality of lights 112 are radially between the diffuser 206 and the second side wall 108 of the base 107. Diffuser 206 may comprise a plastic material, such as polycarbonate (PC), may have a textured or untextured surface, and may be transparent or translucent. If the diffuser 206 is untextured and transparent, light generated by lights 112 may diffuse by way of total internal reflection inside diffuser 206.

The cover 208 may take the form of a ring so as to cover over and overhang the circumference (or perimeter) of the light assembly 212. The cover 208 may be partially, substantially, or fully opaque to as to obscure or prevent the lights 112 from being directly seen. The cover 208 may comprise, for example, a plastic material such as ABS.

By the arrangement of the light assembly 212 and the cover 208, the lights 112 may shine generate a partially or substantially uniform ring of light facing toward a radially inward direction of the lighting device 100. In some examples, diffusion of light within the chamber 109 may be further effectuated by a matte or frosted characteristic of the first wall 102 and/or first side wall 106. The light generated by the lights 112 may become, to a certain degree, evenly distributed across the inner surfaces of the first wall 102 and the first side wall 106.

According to some aspects of the present disclosure, the second inner panel 204 adjacent to the light assembly may be at least partially or completely opaque, such that components disposed within the base 107 are hidden from view during use of the lighting device 100. The second inner panel 204 may comprise a plastic material, such as ABS and/or a reflective material or coating. For example, the inner surface of the second inner panel 204 (facing towards the chamber 109) may be reflective, e.g., having a reflective coating, such that light may be more effectively redirected upward into the chamber 109. The second inner panel 204 may have stepped cross-section, wherein the upper portion of the second inner panel 204 has a cross-sectional dimension greater than the bottom portion of the second inner panel 204 (see FIG. 4C). This stepped configuration may be complementary to the shape of the cover, as discussed below, to allow for a seal.

The base 107 may house one or more electronic components in operable communication with the lights 112. For example, the lighting device 100 may further comprise a battery 214, e.g., a rechargeable battery, and one or more processors, which may be coupled to a support such as a printed circuit board 201. Such components may be coupled together as a circuit board assembly. In some examples herein the lighting device 100 may include one printed circuit board (as shown in FIGS. 2A-2B), or two or more printed circuit boards. The battery 214 may be in communication with the solar panel(s) 122, such that the battery 214 may store power generated by the solar panel(s) 122. The battery 214 also may be in communication with the lights in order to supply power to the lights 112. While omitted from the drawings for purposes of simplicity, the lighting device 100 may have electrical connections to supply power from the battery 214 to the lights 112. In some examples, the second inner panel 204 may have a hole or notch to allow electrical wiring to pass through the second inner panel 204 for communication with the light assembly 212. The wiring may run directly from the battery 214 to the lights 112 and/or via the printed circuit board 201 (e.g., each of the battery 214 and the light assembly 212 being in communication with the printed circuit board 201). The battery 214 may have any suitable capacity. In some examples herein, the battery 214 may have a capacity of from about 1500 to about 2500 mAh (e.g., 2000 mAh). The size and shape of the battery 214 may depend on the overall size of the lighting device 100, the types of lights 112, and/or the types of electronic devices that the lighting device 100 is configured to charge. In general, the battery 214 may be of any suitable dimension (e.g., prismatic or cylindrical) and may be of any suitable chemistry or composition (e.g., lithium-ion, nickel manganese cobalt oxide (NMC), ferric, etc.).

As shown in FIG. 2B, the electronic assembly comprising the printed circuit board 201 may include a microprocessor 202 to implement control functionalities and/or a wireless communication chip 203, such as a Bluetooth, RF, Wi-Fi, or Zigbee chip. In this particular illustration, the solar panel 122 is shown as being coupled to a surface of the printed circuit board 201 opposite the surface to which the battery 214, microprocessor 202, and communication chip 203 are coupled. It is understood that these components may be arranged in different configurations that allows for communication among the components. The printed circuit board 201 may include any active and/or passive electronic components useful for implementing the functionalities discussed in this disclosure.

Figure 8:
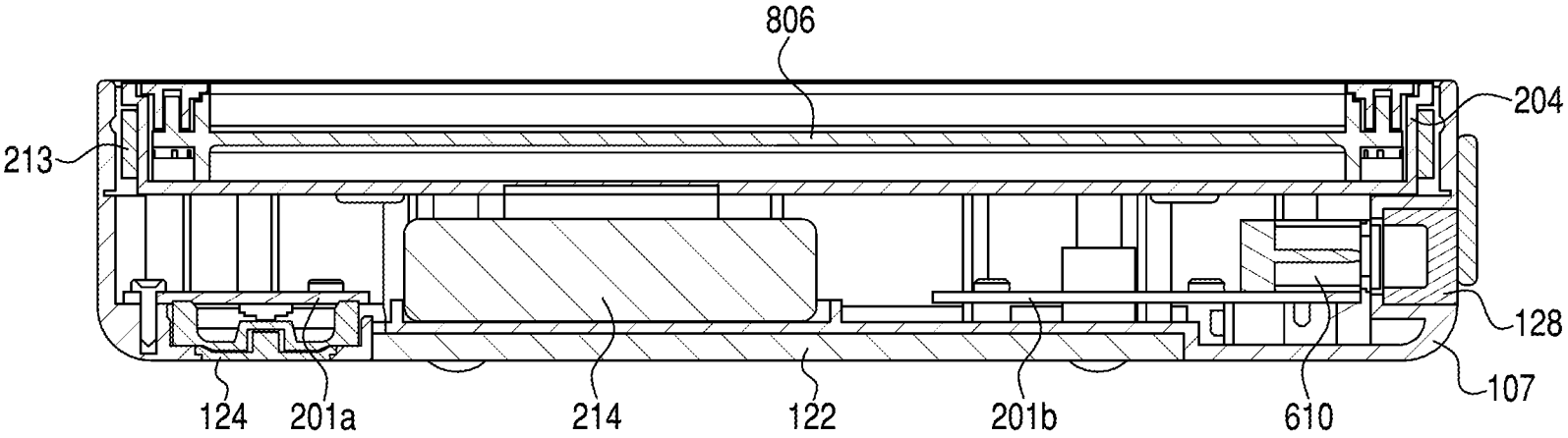
FIG. 8 is a cross-sectional view of a lighting device, according to one or more embodiments.

The second side wall 108 of the base 107 may have one or more slots 230 each aligned with an electronic port 127 (see also electronic port 610 in FIG. 8). The electronic port cover 128 may comprise any suitable material or combination of materials, including polymers such as plastics or silicone. The electronic port cover 128 may have one end that is fixed to the second side wall 108 at the edge of the slot 230. The electronic port(s) 127 may be used to charge the battery 214, and/or transmit data or power between the lighting device 100 and an external electronic device.

In some examples herein the circuit board assembly, including the printed circuit board 201, may be coupled to an inner surface of the second wall 104. For example, the printed circuit board may be attached to the second wall via screws, clips, adhesive, or other mechanisms. For example, the second wall 104 may have protruding screw bosses (screw covers) 216, such that screws 218 may be used to couple the second wall 104 (and/or the base 107 as a whole) to the printed circuit board 201. The screw bosses 216 may comprise rubber or other suitable insulating materials, and may be permanently attached to the second wall 104 with an adhesive. The second wall 104 may have a hole or recess 220 to accommodate the solar panel 122 disposed on the opposite side of the printed circuit board 201.

Figure 3:
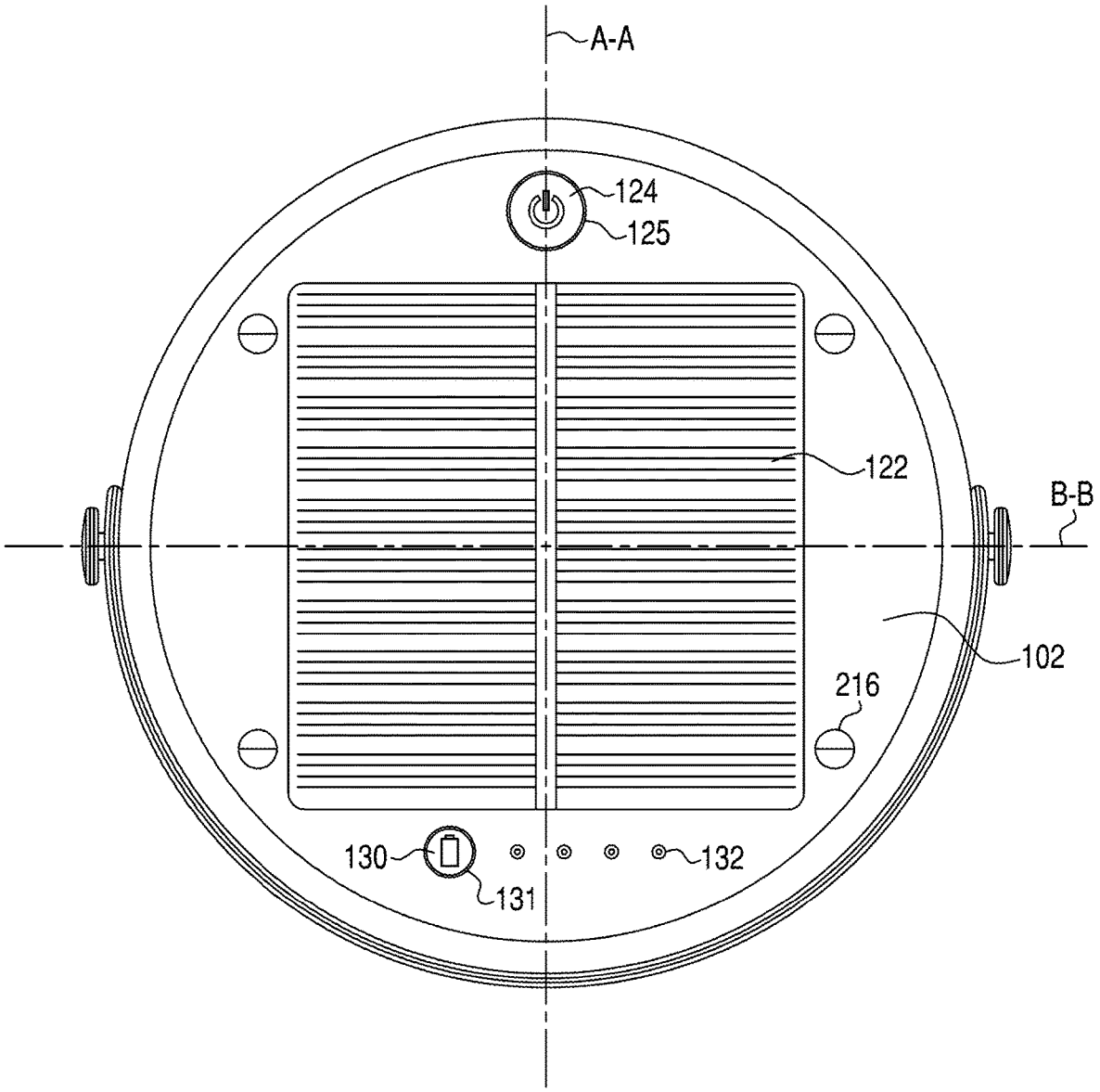
FIG. 3 is a view of a surface of a lighting device, according to one or more embodiments.

FIG. 3 is a bottom view of the lighting device 100, showing the second wall 104, a first slot 125 for the first button 124, a second slot 131 for the second button 130, and screw bosses 216. The buttons 124, 130, the screw bosses 216, and the bottom surface of the solar panel 122 may be, e.g., substantially flush with the surface of the second wall 104, such that the second wall 104 may lay flat against a surface. The surface of the solar panel 122 may be covered with a film or other material to protect the surface from damage while still permitting exposure to sunlight for generating power. For example, a laminate may be applied to cover the solar panel 122 and/or the entire surface of the second wall 104. The laminate may allow for actuating any user elements, e.g., buttons 124, 130.

Figure 4A:
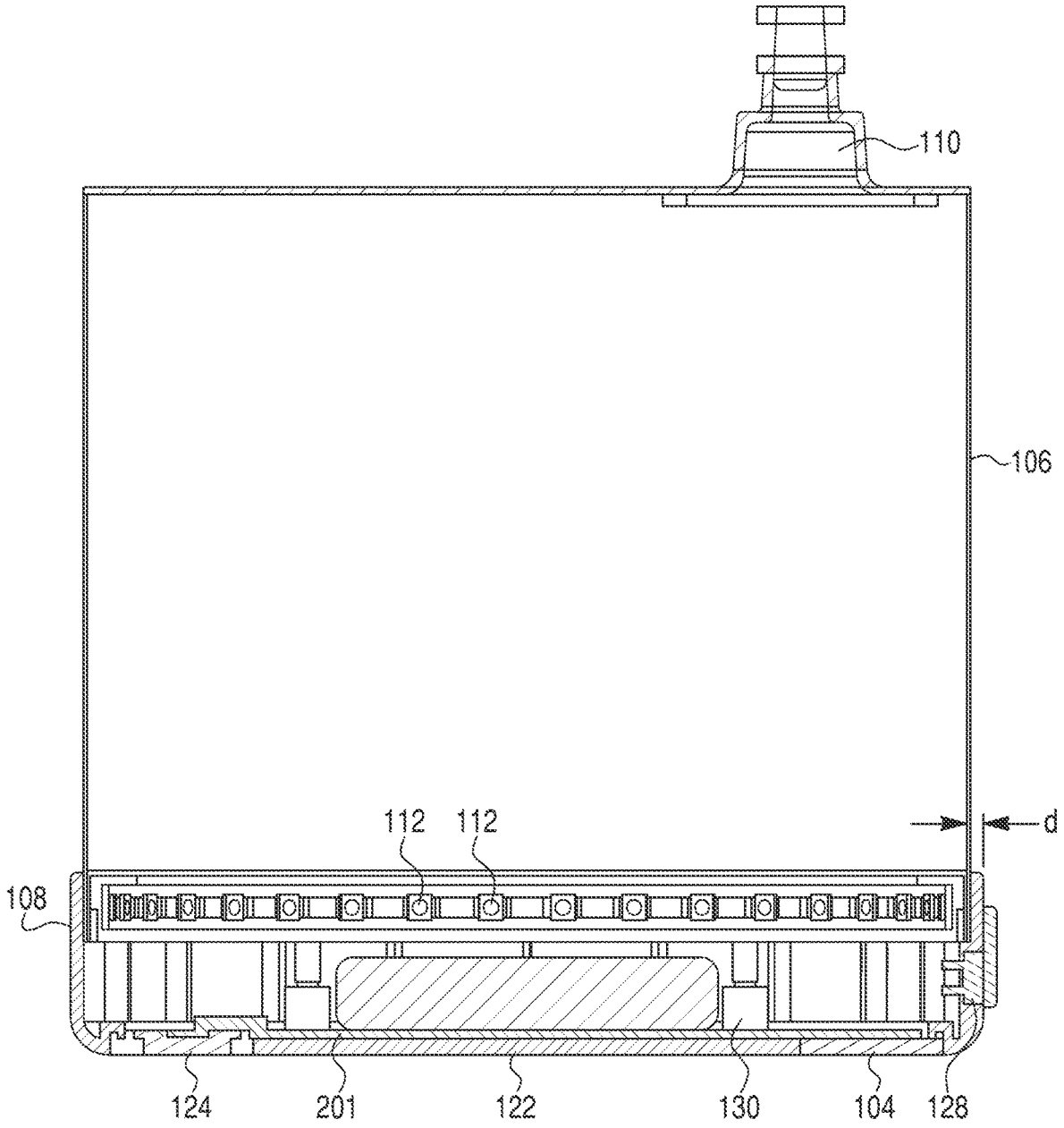
FIGS. 4A, 4B, and 4C are cross-sectional views of a lighting device, according to one or more embodiments, wherein FIG. 4C provides a close-up view of features in FIG. 4B.
Figure 4B:
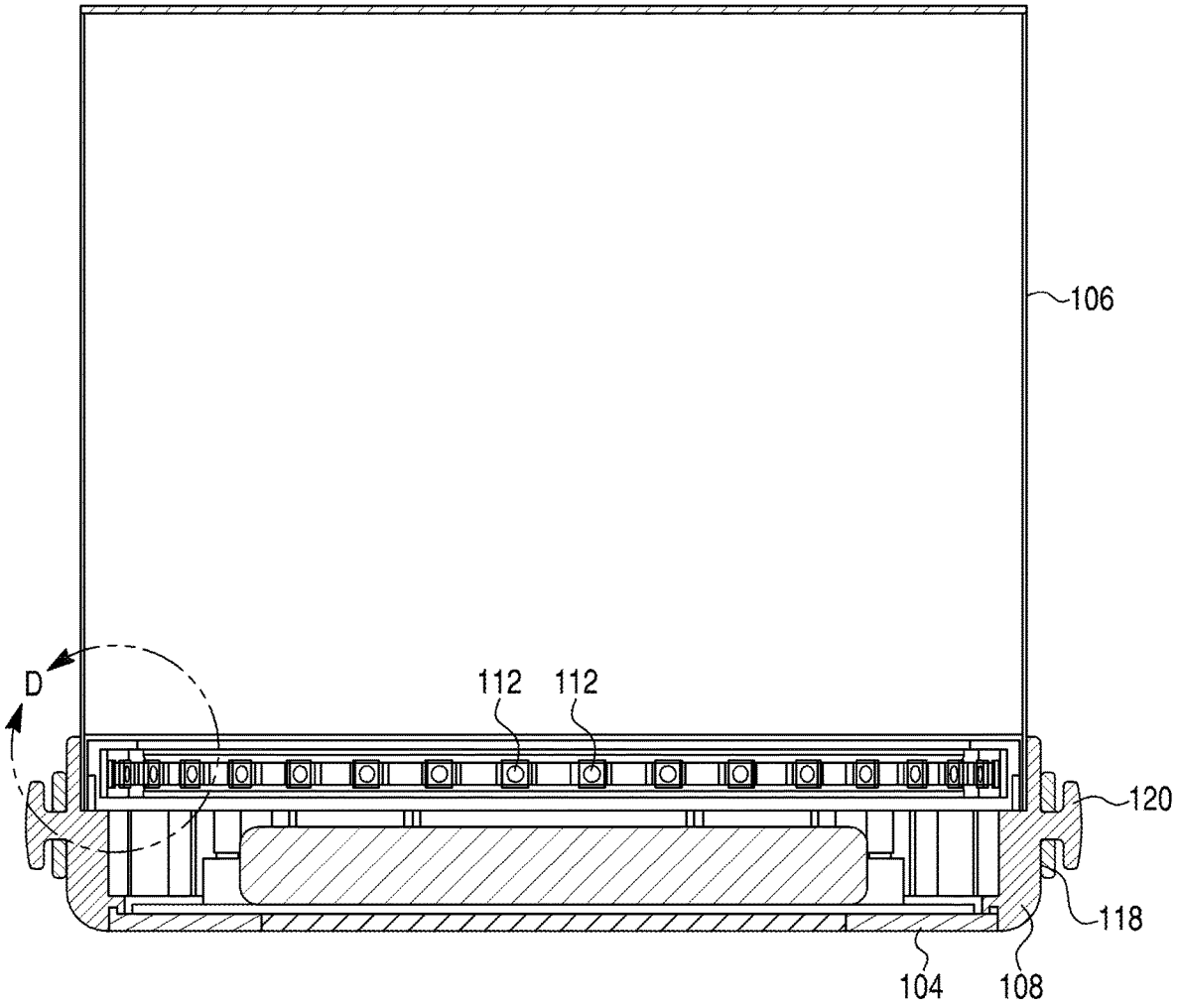

FIG. 4A is a cross-sectional view of the lighting device 100, taken along the cross sectional plane denoted A-A in FIG. 3. FIG. 4B is a cross-sectional view of the lighting device 100, taken along the cross sectional plane denoted B-B in FIG. 3. As shown in FIG. 4A, the outer surface of the second side wall 108 may be offset by a distance d from the outer surface of the first side wall 106.

Figure 4C:
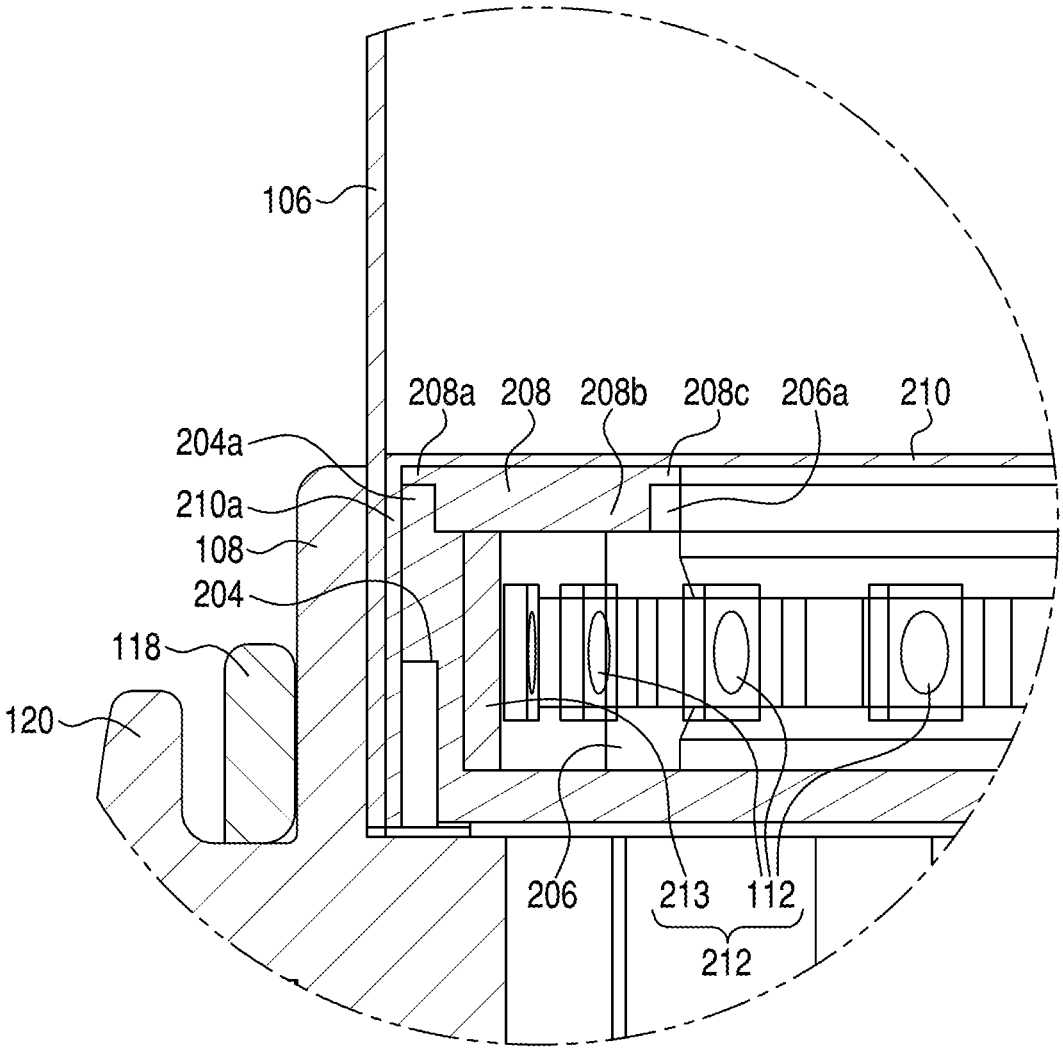

FIG. 4C is a close-up view of the portion labeled "D" in FIG. 4B. As shown in FIG. 4C, the light assembly 212 comprising lights 112 and the support 213 may be disposed between the cover 208 and the second inner panel 204. These components may be positioned underneath the first inner panel 210.

The cover 208 may have an outer peripheral portion 208*a* and an inner peripheral portion 208*c* that are, in an axial direction (corresponding to the vertical direction of FIG. 4C), thinner than a central portion 208*b* between the inner peripheral portion and the outer peripheral portion. Additionally, the upper surfaces of the portions 208*a*, 208*b*, 208*c* may be flush with each other, so as to result in a T-shaped cross section for cover 208. In the cross section shown in FIG. 4C, the width of the central portion 208*b* may be greater than the width of the outer peripheral portion 208*a* and the width of the inner peripheral portion 208*c*.

The diffuser 206 may have a lip 206*a*, so as to have a stepped structure. When the diffuser 206 is assembled with the cover 208, the lip 206*a* may be located below the inner peripheral portion 208*c* and adjacent to the inner peripheral surface of the central portion 208*b*. The upper portion of the second inner panel 204 may have a protrusion 204*a* so as to provide for a stepped structure. As shown in FIG. 4C, the T-shaped cross section of the cover 208 may fit between the stepped structure of the diffuser 206 and the stepped structure of the second inner panel 204. The overlapping portions of the first side wall 106 and the second side wall 108 as shown in FIG. 4C may abut.

In some examples, the first side wall 106 and the second side wall 108 may be permanently attached to each other with an adhesive. In other examples, the first side wall 106 may be selectively detachable from the base 107, e.g., by removing the bottom of the first side wall 106 from a groove within the base 107 between the second side wall 108 and the second inner panel 204.

According to some aspects of the present disclosure, the base 107 may be selectively detachable from, and reattachable to, the chamber 109. Such examples may allow for interchanging different types of chambers 109 (e.g., having different shapes, different designs on the side wall(s) 106 and/or first wall 102, comprising flexible materials vs. rigid materials, being inflatable with a valve vs. lacking a valve, etc.) with different types of bases 107 (e.g., comprising different combinations of lights 112 and/or different electronic components, etc.).

For example a lower portion of the chamber 109 may include mating elements complementary to mating elements of the base 107. Exemplary mating elements include, but are not limited to, clips, magnets, threads, friction-fit, grooves, and projections/recesses, among other possible mating elements. For example, the base 107 may be magnetically coupled to the chamber 109. In such examples, the first side wall 106 and/or the first inner panel 210 may be magnetically attached to the base 107 using magnet(s) coupled to the first side wall 106 and/or the first inner panel 210, and complementary magnet(s) coupled to a portion of the base 107, such as cover 208 and/or second side wall 108.

In some examples, the first side wall 106 together with the first inner panel 210 may be selectively detachable from the base 107, e.g., by removing the bottom of the first side wall 106 together with the bottom of the first inner panel 210 from a groove within the base 107 between the second side wall 108 and the second inner panel 204. In such examples, the first side wall 106 and the inner panel 210 may remain attached to each other upon being detached from the base 107. Additionally or alternatively, the first side wall 106 together with the first inner panel 210 may be magnetically attached to the base 107 using magnet(s) placed on the first side wall 106, the first inner panel 210, and/or the base 107.

In some examples herein, the overall width (e.g., diameter or maximum cross-sectional dimension) of the lighting device 100 may range from about 100 mm to about 150 mm, e.g., from about 110 mm to about 140 mm, or from about 120 mm to about 130 mm. It is noted that the various dimensions discussed in this disclosure are exemplary only and not limiting. For example, the overall width (e.g., diameter or maximum cross-sectional dimension may be greater than 150 mm, such as within a range of about 150 mm to about 200 mm, e.g., from about 150 mm to about 155 mm, or from about 160 mm to about 175 mm.

Figure 5A:
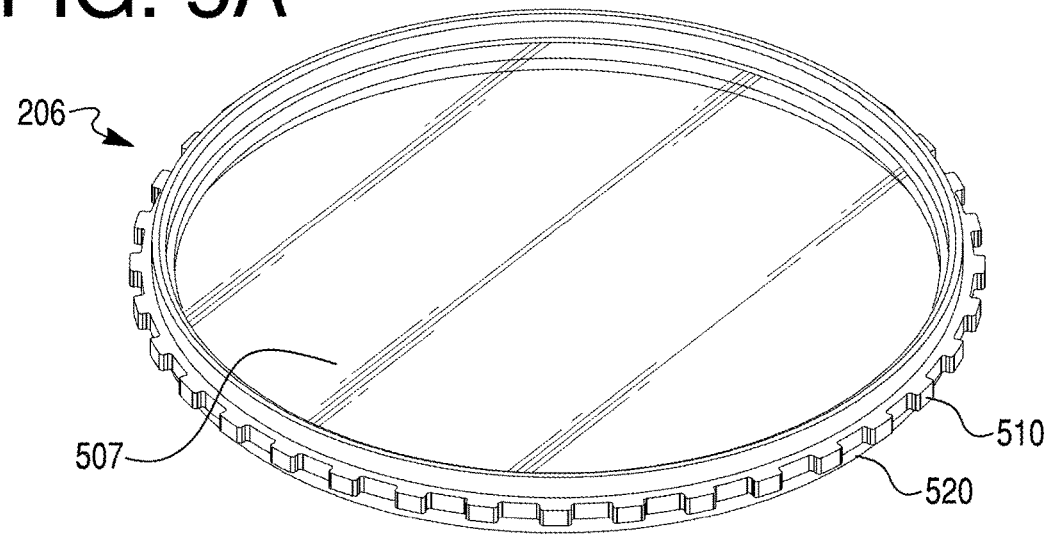
FIGS. 5A-5E are views of a light diffuser of a lighting device, according to one or more embodiments.
Figure 5B:
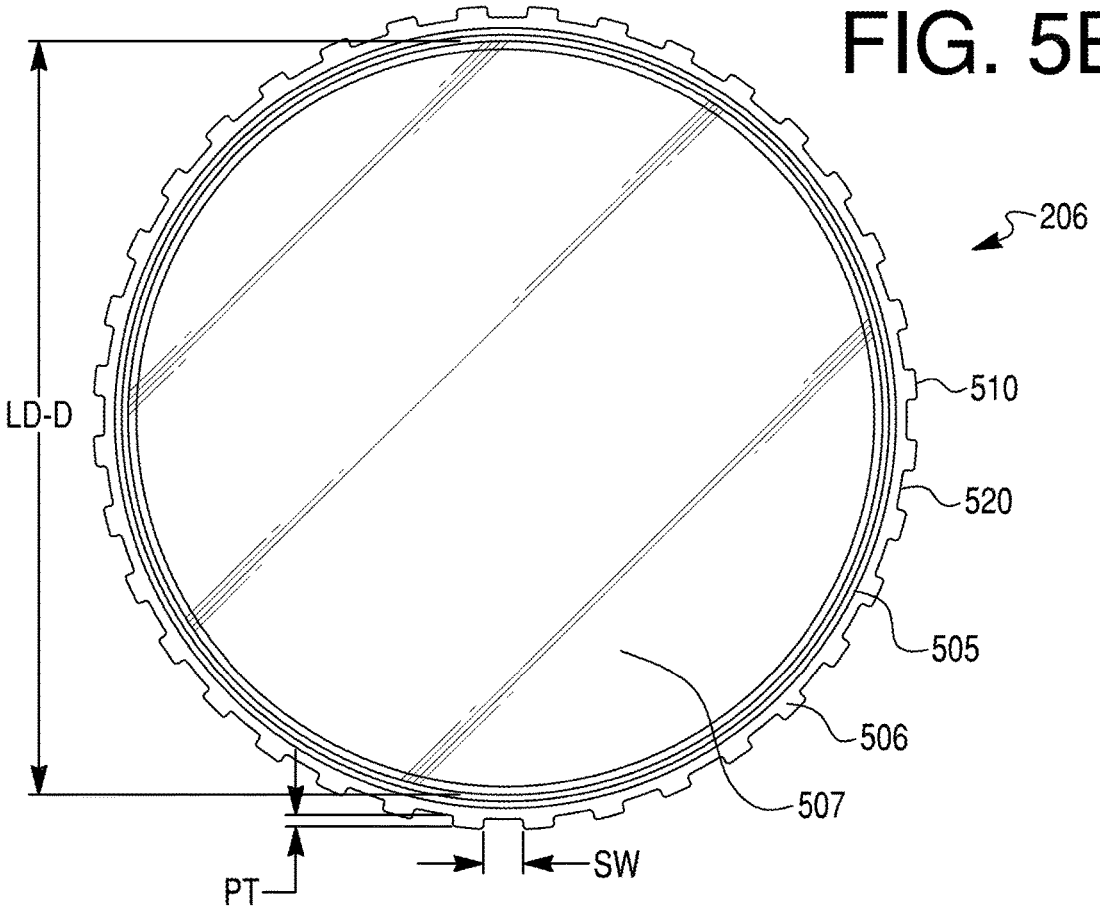
Figure 5C:
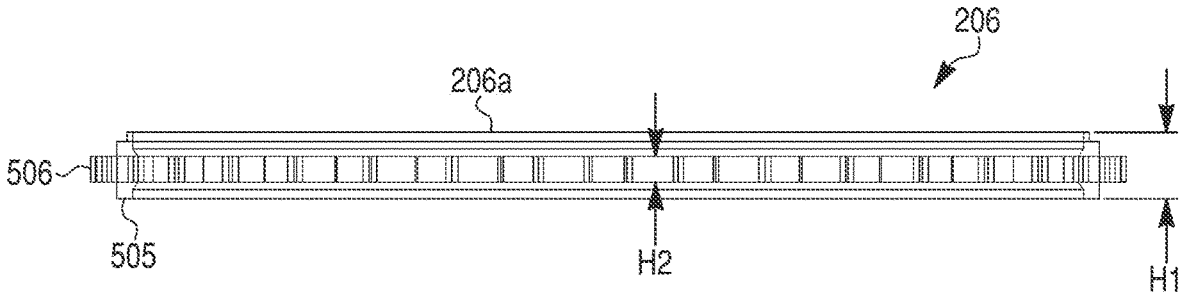
Figure 5D:
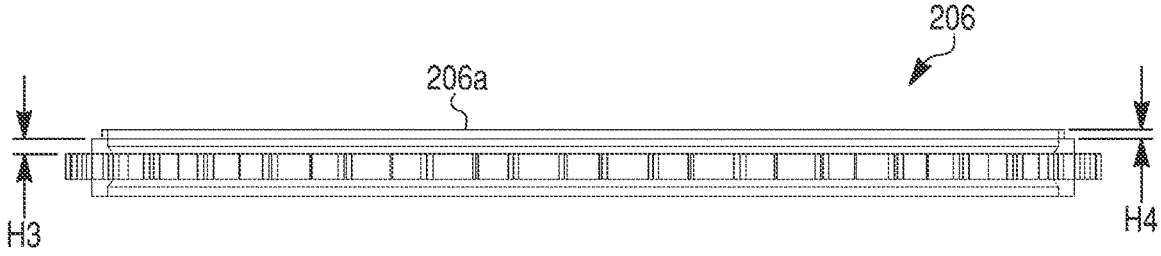
Figure 5E:
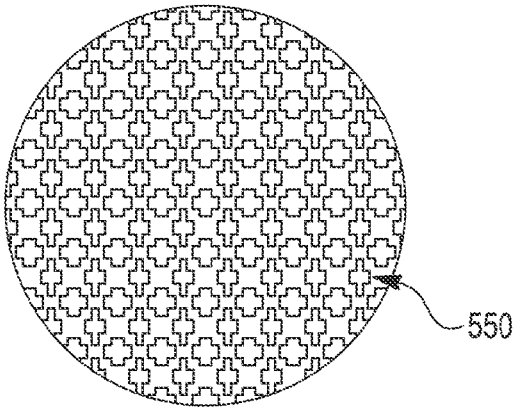

FIGS. 5A-5E illustrate an example of the diffuser 206. FIG. 5A is a perspective view of the diffuser 206. FIG. 5B is a top view, and FIGS. 5C-5D are side views. FIG. 5E illustrates an exemplary surface texture, according to some aspects of the present disclosure. As shown in FIGS. 5B-5D, the diffuser 206 may have a central portion 505 and an outer portion 506 radially outward from the central portion 505. The outer portion 506 and the central portion 505 may be separate components or may be integral portions of a single unit diffuser 206.

The outer periphery of the outer portion 506 may include a plurality of slots or recesses 520 in between protrusions 510. The protrusions 510 and recesses 520 may be formed along the entire outer periphery of the diffuser 206, as shown, so as to give the diffuser 206 a gear-like appearance in the plan view shown in FIG. 5B. In other examples, only a portion of the diffuser 206 may include recesses, e.g., for configurations in which the plurality of lights 112 are disposed along less than the full perimeter of the lighting device 100. When the diffuser 206 is assembled with the support 213, the lights 112 coupled to the support 213 may fit into corresponding recesses 520. The protrusions 510 may each have a substantially same size (or arc length). Additionally, the recesses 520 may be arranged at regular intervals around the outer periphery of the outer portion 506 of the diffuser, e.g., wherein each recess 520 is equidistant between two adjacent recesses 520. In such cases, the plurality of lights 112 may be similarly arranged at regular intervals, each light 112 being equidistant between two adjacent lights 112. The total number of recesses 520 may be the same as the total number of lights 112.

Each recess 520 may have a slot width SW large enough to accommodate the lights 112 of the lighting assembly 212. As shown in FIG. 5C, the central portion 505 of the diffuser 206 may include a lip 206*a* on the upper side of the central portion 505.

As example dimensions, the slot width SW may range from about 3 mm to about 10 mm, e.g., about 5 mm. The protrusion height PT, which corresponds to the slot depth, may range from about 1 mm to about 3 mm, e.g., about 1.50 mm. The overall height H1 of the diffuser 206 may range from about 3 mm to about 10 mm, e.g., about 5 mm or about 7 mm. The height H2 of the outer portion 506 may range from about 1 mm to about 5 mm, e.g., about 2 mm to about 3 mm, or about 2.50 mm. The initial step height H3 of central portion 505 relative to the outer portion 506 may range from about 1 mm to about 2 mm, for example, and the height H4 of the lip 206*a* may range from about 0.5 mm to about 1.5 mm, e.g., about 0.75 mm or about 0.85 mm. It is understood that these dimensions are exemplary only and may vary according to the overall dimensions of the lighting device 100.

In FIGS. 5A-5E, the diffuser 206 has a ring-shaped portion and may also have a wall (or disc or panel) 507, such that the diffuser 206 forms a wall-like structure. The wall 507 may, for example, be a single panel that is aligned with the outer portion 506 and has a thickness that is the same or substantially the same as height H2 shown in FIG. 5C. The wall 507 has a diameter LD-D and may be integral with the outer portion 506 and/or the central portion 505. In some examples, at least a portion of the diffuser 206 may include a texture. For example, in examples wherein the diffuser forms a wall-like structure, the upward-facing surface of the wall 507 may have a light diffusion texture 550, such as that shown in FIG. 5E, to increase diffusion of light. In FIG. 5E, the pattern may have a pitch of about 0.5 mm in one direction or in two mutually orthogonal directions. In some examples, the diffuser 206 is an open ring (or loop), without a wall that closes the central opening of the diffuser. For example, the wall 507 may be omitted.

The diffuser 206 may act as a light guide through which light originating from the lights 112 are guided to the inner peripheral surface of the diffuser 206. Light guided in this manner may undergo total internal reflection on the upper and lower surfaces of the diffuser 206 until reaching the inner peripheral surface. Additionally, in some embodiments, one or more surfaces of the diffuser, e.g., all or a portion of wall 507, may have a pattern of light-extracting cones to extract light. The cones cause some of the light that would have undergone total internal reflection at the upper surface of the diffuser 206 to instead be extracted out from the upper surface.

Figure 6A:
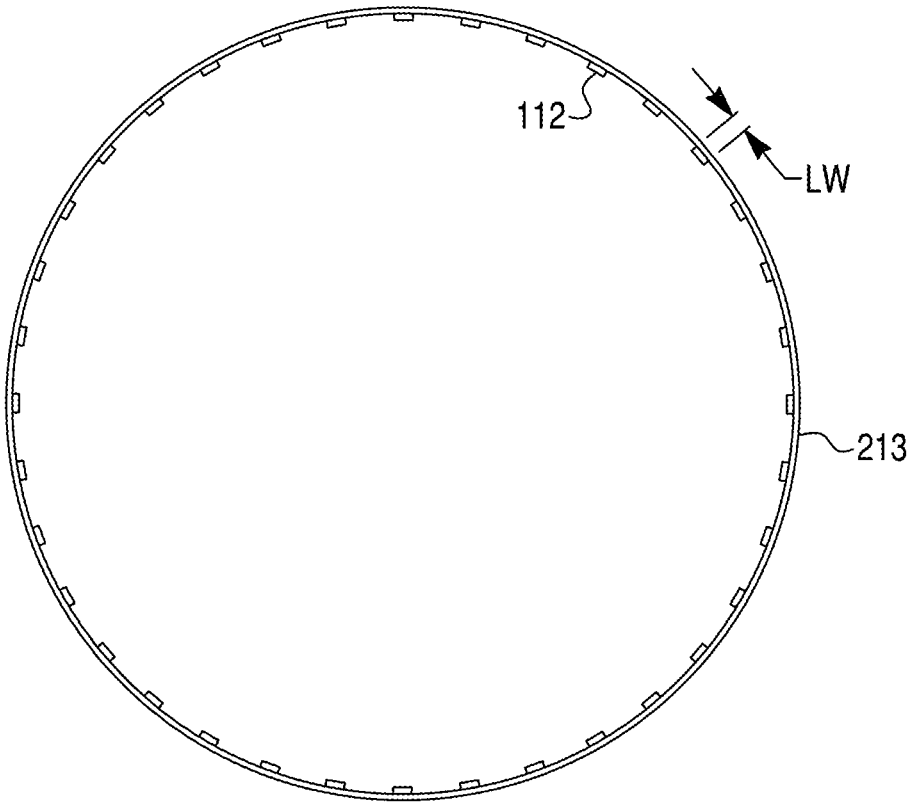
FIGS. 6A and 6B are views of a light assembly of a lighting device, according to one or more embodiments.
Figure 6B:
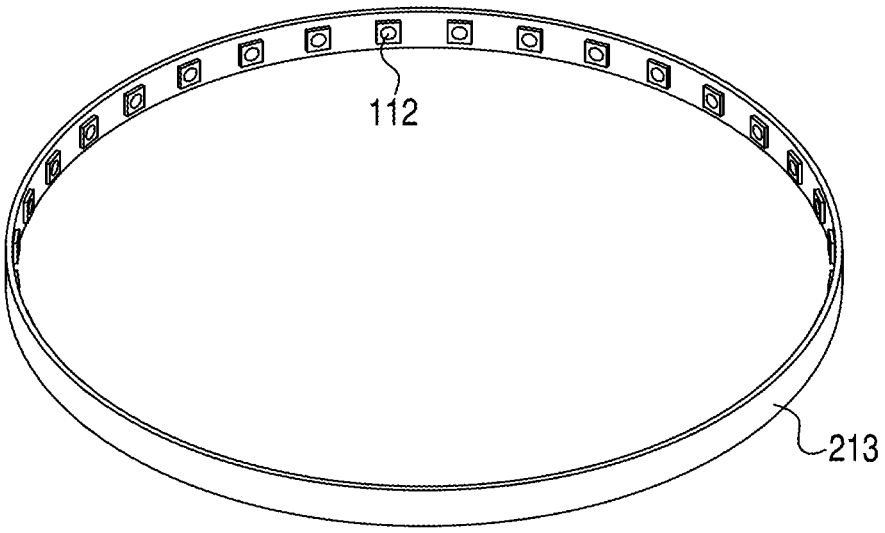

FIGS. 6A-6B illustrate a portion of the light assembly 212, including the plurality of lights 112 coupled to the support 213. The support 213 may take the form of a flexible strip that may be wrapped around the diffuser 206, e.g., forming a closed loop. The support 213 may include electrical connections for each of the lights 112, such that the lights 112 may be powered simultaneously or sequentially, e.g., based on instructions from a microprocessor 202.

The lights 112 may be disposed along the support 213 at a regular pitch so that the lights 112 are evenly distributed along the support 213. The pitch may be dimensioned such that the lights 112 respectively fit within the recesses 520 of the diffuser 206. The lights 112 may have individual widths LW that are less than or equal to the size of the recesses 520.

As mentioned above, the lights 112 may be LED lights, and the plurality of lights 112 may include any combination of white lights and/or RGB lights. White lights may be white LED lights that emit white light or substantially white light. The white LED lights may have the color of white 4000 K, or of various other colors, including white 2700 K, white 5000 K and color temperature in between. The RGB lights be RGB LED lights whose colors can be variably adjusted.

In some examples herein, the plurality of lights 112 includes a plurality of white lights, a plurality RGB lights, or a combination thereof. The total number of lights 112 may range from 2 lights to 50 or more lights, e.g., 5 to 40 lights, 6 to 18 lights, 12 to 36 lights, 5 to 25 lights, 10 to 20 lights, 15 to 30 lights, 18 to 48 lights, or 30 to 50 lights. In the case of a combination of white lights and RGB lights, the ratio of white lights to RGB lights (white lights:RGB lights) may range from 1:20 to 20:1, e.g., a ratio of 1:1, 2:1, 1:2, 3:1, 1:3, etc. In some examples, the white lights and the RGB lights may be disposed along the support 213 in an alternating arrangement in which one or a plurality of consecutive white light(s) are alternately arranged with one or a plurality of consecutive RGB light(s), so that white and RGB lights are evenly distributed along the support 213. For example, the plurality of lights 112 may include a plurality of white lights and a plurality of RGB lights arranged in a 2:1 ratio (e.g., white, white, RGB, white, white, RGB) alternating arrangement, e.g., providing for a total of 10 white lights and 5 RGB lights, a total of 12 white lights and 6 RGB lights, a total of 24 white lights and 12 RGB lights, or a total of 30 white lights and 15 RGB lights.

Figure 7A:
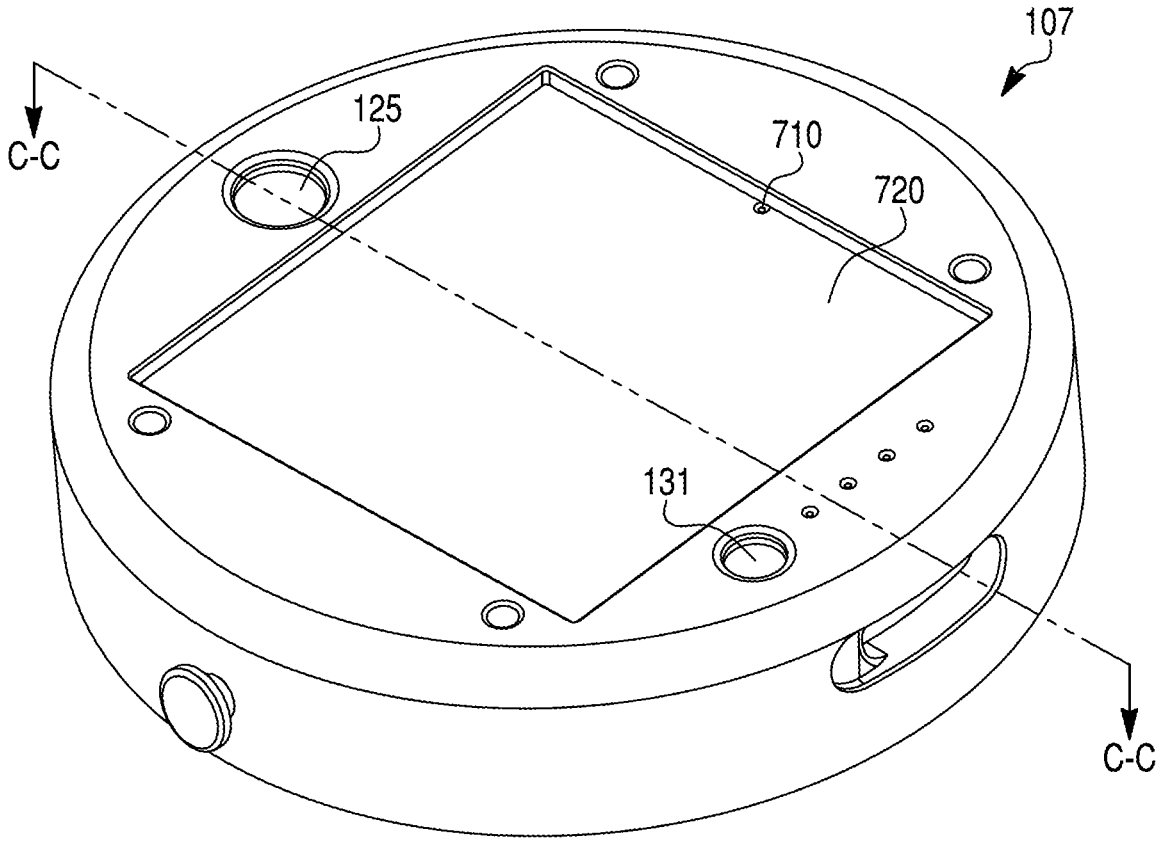
FIGS. 7A and 7B are views of a base of a lighting device, according to one or more embodiments.
Figure 7B:
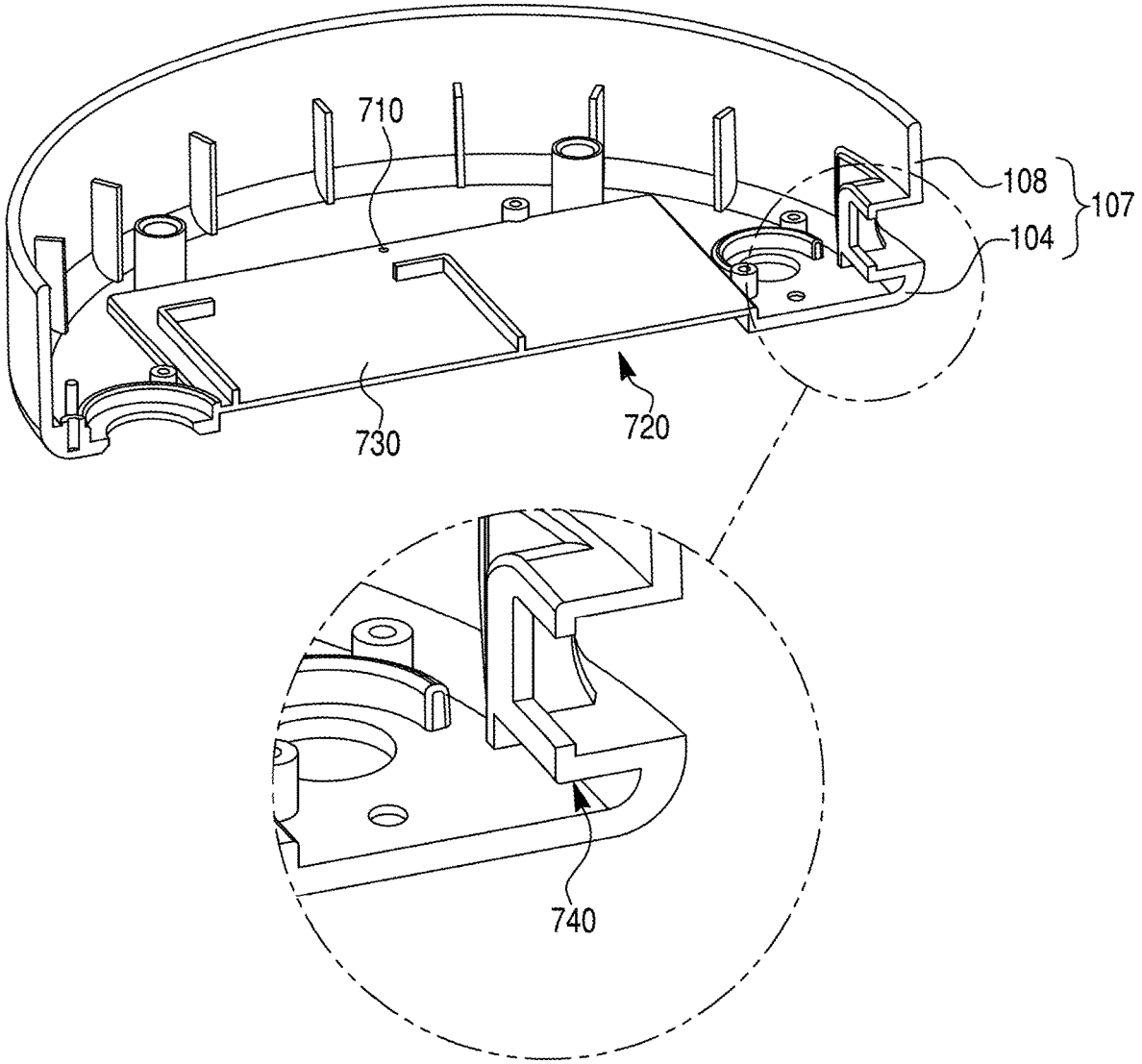

While FIGS. 2A and 2B show an example of a second wall 104 configure to accommodate a solar panel 122 attached to the printed circuit board 201, FIGS. 7A-7B illustrate another example of the second wall wherein the solar panel 122 is in communication with the printed circuit board 201 but not directly attached to a surface of the printed circuit board 201. In this example, the second wall 104 includes a recess 720 for receiving the solar panel 122. The base 107 may have a through hole or notch 710 to permit the passage of wiring between the solar panel 122 and electronic components (e.g., printed circuit board 201) contained within the base 107.

As shown in FIG. 7B, the interior of the base 107 may have a bracketed slot 730 for placement of the battery 214. In FIGS. 7A-7B, the second wall 104 and the second side wall 108 may be integrally formed, as respective portions of a one-piece member constituting the base 107 (or part of the base 107). The base 107 may include a protrusion 740 to accommodate the electronic port cover 128.

FIG. 8 illustrates the base 107 shown in FIGS. 7A-7B, along with additional components placed in the base 107, including button 124 (or other user element), battery 214, solar panel 122, and electronic port 610. In this configuration, the printed circuit board 201 is implemented as a plurality of printed circuit boards, shown as printed circuit boards 201*a* and 201*b*. The printed circuit boards 201*a* and 201*b* may be communicatively connected with each other, so that the microprocessor 202 is configured to control or transmit/receive data from the various electronic components of the lighting device 100. The electronic port 610 may be a male or female connector.

The upper portion of FIG. 8 shows of a light diffuser 806, the second inner panel 204, and the support 213 according to some embodiments. The support 213 and a plurality of lights (e.g., LEDs) may be both placed outside of the second inner panel 204 as shown. In other embodiments, instead of the arrangement shown in FIG. 8, the upper portion of FIG. 8 (e.g., the portion above battery 214) may instead have the configuration shown in FIG. 4C, where the support 213 is placed between the second inner panel 204, and the light diffuser has the configuration shown in FIG. 4C and in FIGS. 2A, 2B, 5A, and 5B.

Figure 9:
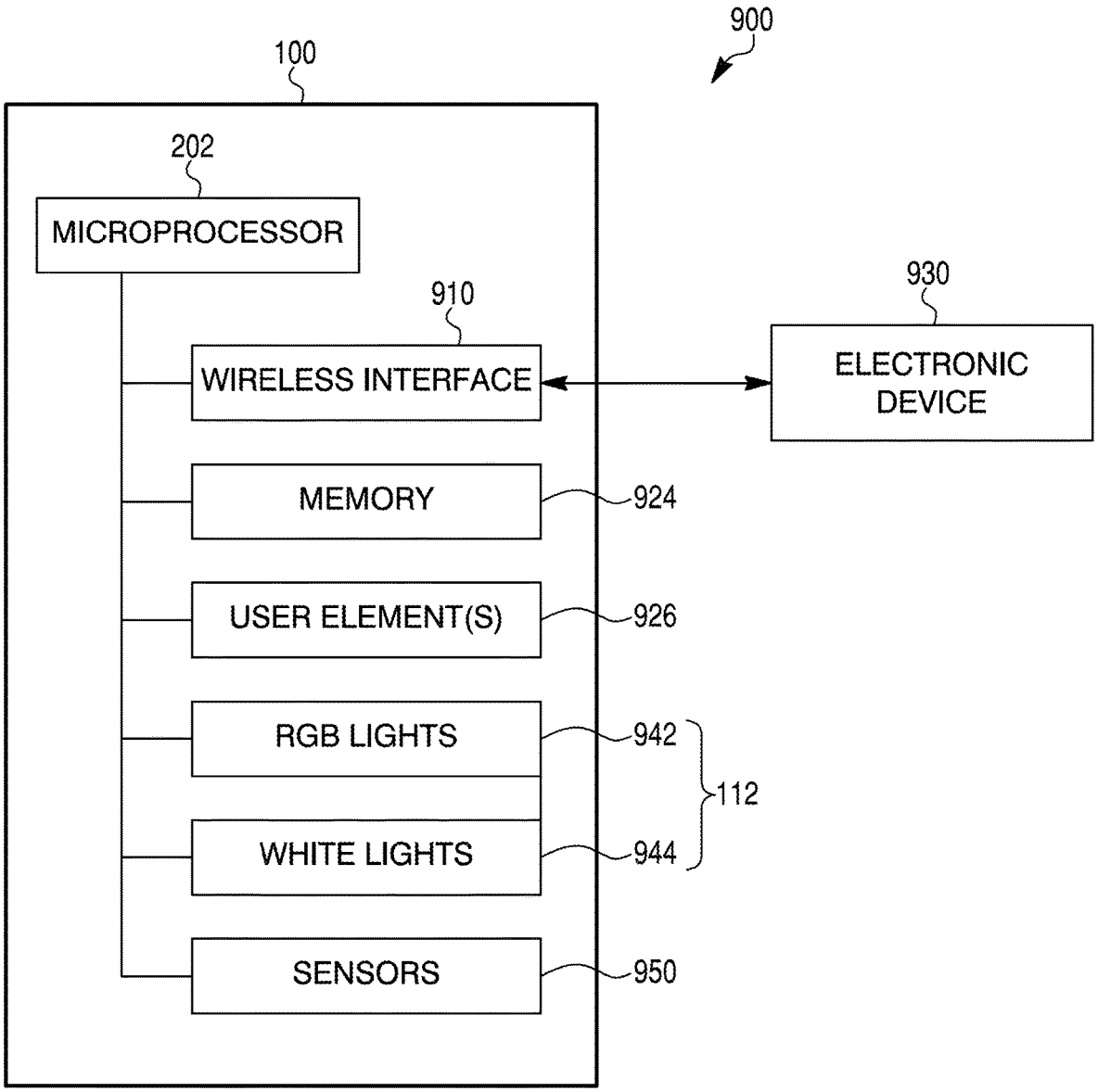
FIG. 9 is a diagram illustrating components of a lighting device and its operation in a system, according to one or more embodiments.
Figure 10:
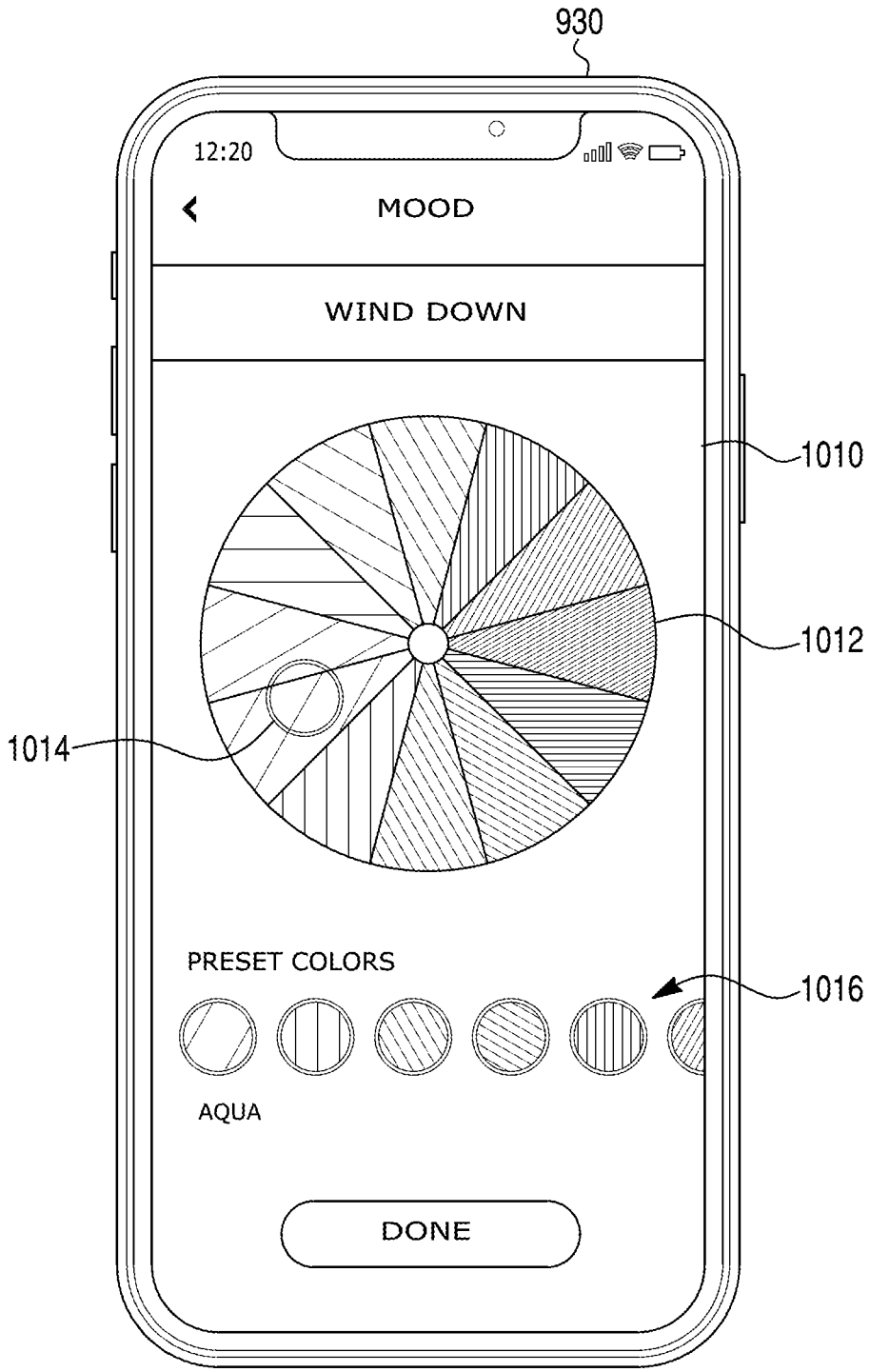
FIG. 10 illustrates an example of an interface of an electronic device that may be used to control a lighting device, according to one or more embodiments.

FIG. 9 illustrates a system diagram of the lighting device 100, as part of a larger system 900 comprising the lighting device 100 and an external electronic device 930. The electronic device 930 may be any electronic device capable of controlling the lighting device 100. The electronic device 930 may be, for example, a computing device such as a smartphone, tablet, laptop, desktop computer, or a remote controller. The electronic device 930 may communicate with the lighting device 100 through a wireless interface 910 of the lighting device 100. The wireless interface 910 may include a transceiver (or receiver and transmitter) configured to implement communication using a wireless communication protocol, such as Bluetooth, a near-field communication (NFC) protocol, Zigbee, a RF communication protocol, and/or Wi-Fi. The transceiver may be part of a wireless communications chip 203 (FIG. 2B). Thus, in some examples, the wireless interface 910 includes a Bluetooth chip.

As illustrated in FIG. 9, the lighting device 100 may include a microprocessor 202 configured to perform the functionalities of controlling the lighting device 100, e.g., one or more operating modes of the lighting device 100. The microprocessor 202 may be coupled to memory 924, which may include volatile and/or non-volatile memory. The microprocessor 202 may be configured to detect user input provided to the electronic device 930 (e.g., via manipulation of user element(s) 926 of the lighting device 100), and operate the lighting device 100 according to the user input. The user element(s) 926 may include buttons 124, 130, a touch sensitive display built into the lighting device 100, and/or a motion sensor, etc.

In at least one example, the microprocessor 202 may be configured to operate lights 112 (which may include white lights 944 and RGB lights 942) based on the number of presses of first button 124. For example, starting from an off-state of the lighting device 100, the microprocessor 202 may select different operating modes of the lighting device 100 based on the number of successive user selections (e.g., button presses). An operating mode may specify one or more of the following: (1) a particular set of lights 112 that are turned on (e.g., all lights 112 are turned on, only the white lights 944 are turned on, only the RGB lights 942 are turned, or only some other subset of the lights 112 are turned on, among other examples); (2) the brightness of any one or more of the lights 112 that are turned on; (3) the color of any one or more of the lights 112 that are turned on (e.g., the color of the RGB lights); and (4) whether wireless communication is turned on or off.

For example, upon detecting each successive activation of the first button 124, the microprocessor 202 may cycle through a list of operating modes in succession, corresponding the number of times the first button 124 has been pressed. Additionally, after all operating modes have been cycled through, the microprocessor 202 may, upon detection of the next activation of the first button 124, turn off the lighting device 100 (e.g., terminate power from the battery 214 and/or the solar panel 122 to the lights 112). The operating modes may be stored in the memory 924 of the lighting device 100.

For example the lighting device 100 may have the following modes stored in the memory 924. The following operating modes are exemplary only and non-limiting of additional examples encompassed herein.

TABLE 1

| Button Press | Mode |
|---|---|
| PRESS #1 | Light & Bluetooth Turns On (75% Brightness) |
| PRESS #2 | Light Pink |
| PRESS #3 | Light Blue |
| PRESS #4 | Light Green |
| PRESS #5 | Light Yellow |
| PRESS #6 | Light & Bluetooth Off |
| PRESS #1 (starts over from the beginning) | Light & Bluetooth Turns On (75% Brightness) |

To implement the operating modes listed above, the microprocessor 202 may control the lights 112 so that during the first operating mode listed in Table 1, only the white lights are turned on, and during the second through fifth operating modes listed in Table 1, only the RGB lights are turn on, at specific colors respectively specified (e.g., RGB values of 0 to 255 each) by the operating modes. For example, the color of each RGB light may be turned on at a color specified by a combination of red, green, and blue color values, where the red color value, the green color value, and the blue color value may each range from 0 to 255. Such combinations may allow for a multitude of different colors of the lighting device 100 for selection by a user, such as, e.g., at least 50, at least 100, at least 150, at least 200, at least 250, at least 300, at least 350, at least 400, at least 450, or at least 500 or more different colors of light. A combination of red, green, and blue color values each ranging from 0 to 255 may allow for $10^7$ (e.g., 16777216) colors to be specified. Additionally or alternatively, a user may select the intensity of light and/or other operating modes such as flickering light, fade in/fade out, etc. Furthermore, while an RGB color space of 8 bits (256 possible values) for each of red, green, and blue, has been provided as an example, other color spaces may additionally or alternatively be used.

Other operating modes and variants of the above operating modes are also contemplated and included herein. For example, wireless communication capabilities may remain on without any of the lights 112 being turned on. Further, for example, both white and RGB lights may be turned on simultaneously. In at least one such example, one or more RGB lights may generate white light. Additionally, operating modes may also be customized and specified by a user using electronic device 930, e.g., via user element(s) 926 and/or input provided through external electronic device 930 via wireless communication with wireless interface 910 of the lighting device 100. The operating modes may include controlling one or more lights 112 independently of one or more other lights 112, such as turning lights 112 off and on, adjusting intensity to simulate flickering light, adjusting the intensity of light (e.g., settings of dim, medium, bright, extra bright, etc.), and/or color. For example, one or more operating modes may include adjusting the color of one or more lights 112 independently of the color of one or more other lights 112.

FIG. 9 illustrates the use of electronic device 930 to control the lighting device 100. The electronic device 930 has an installed app (application) designed to control the lighting device 100. That is, the microprocessor 202 may be configured to interface with the electronic device 930 through the app, which may enable the electronic device 930 to transmit various user inputs to control the microprocessor 202 to control the lighting device 100. For example, the app may display a user interface 1010 that includes various options for users to select, including the option to select a color to be displayed by the lighting device 100.

For example, graphical user interface 1010 may include a preset-color section interface 1016 permitting the user to select a pre-set color to be displayed by the lighting device 100. The user interface 1010 may also include a color wheel 1012 permitting the user to make a selection 1014 of the color to be displayed by the lighting device 100. In response to receiving the selection, the electronic device 930 may transmit a message that is received by the wireless interface 910 of the lighting device 100. In response to receipt of the message by the wireless interface 910, the microprocessor 202 may control the lights 112 to implement the color selected by the user. The selection of the specific lights 112 to turn on and the brightness of the lights 112 may be automatic upon selection of the color.

The lighting device 100 and the electronic device 930 may further be configured to enable a user to select, through one or more user interfaces 1010 displayed by the app installed on the electronic device 930, one or more of the specific lights (e.g., sets of the lights 112, with RGB lights being one set, and white lights being another set) to turn on or off, as well as their brightness. The microprocessor 202 of the lighting device 100 may be configured to implement any of the user selections discussed above in response to receiving, through the wireless interface 910, a message from the electronic device 930 indicating such a selection.

The one or more graphical user displays 1010 of the app may also enable a user to turn on off all lights 112 (and/or turn off the lighting device 100 as a whole), set a timer to turn one or more of the lights 112 on/off (and/or turn the lighting device 100 on or off as a whole), set a user-customized schedule to turn on or off one or more of the lights 112 (and/or turn on or off the lighting device 100 as a whole) under specified temporal conditions (e.g., at a certain time of day, or time and day during a week), group multiple lights 112 to control them together, rename individual lights 112 and groups of lights 112, and set operating modes for manual control of the lighting device 100 (e.g., manual control using a user element such as button 124).

In at least one example, the lighting device 100 may include an operating mode wherein the color of light and/or intensity of light is synchronized with the time of day. For example, the lighting device 100 may include a diurnal mode wherein the lights 112 gradually brighten and/or take on a blue/bluish hue from sunrise throughout the day, and gradually dim and/or take on a red/reddish hue from sunset throughout the night.

User inputs involving operation of the lighting device 100 may be transmitted to the lighting device 100 through the wireless interface 910. The microprocessor 202 may control the lights 112 according to the commands received. For example, if the user input specifies a timer to turn one or more of the lights 112 off, then the microprocessor 202 may turn one or more of the lights 112 off upon determining an expiration of the timer. If the user input specifies a schedule including a specified temporal condition to turn on one or more of the lights 112, then the microprocessor 202 may turn on the one or more of the lights 112 upon determining that the specified temporal condition is met. The schedule may further specify a color and brightness of the one or more of the lights 112 when the one or more of the lights 112 are turned on, in which case, upon determining that the specified temporal condition is met, the microprocessor 202 may turn on the one or more lights 112 at the specified color and brightness.

Additionally, or alternatively, as illustrated in FIG. 9, the lighting device 100 may include one or more sensors 950 to detect a surrounding environment. The sensor(s) 950 may be configured to detect, for example, a brightness, a temperature, and/or a color tone of the surrounding environment. Information obtained by the sensor(s) 950 may be utilized by the microprocessor 202 to control lights 112. The sensor(s) 950 may be part of the user interface element(s) 926. For example, the sensor(s) 950 may include motion sensor(s) configured to detect motion of a user, and the microprocessor 202 may control the lights 112 based on the detected motion. For example, the microprocessor 202 may cycle through operating modes in response to detection of motion.

It should be appreciated that in the present disclosure, various features are sometimes grouped together in a single embodiment, example, figure, or description thereof for the purpose of streamlining the disclosure and aiding in the understanding of one or more of the various inventive aspects. This method of disclosure, however, is not to be interpreted as reflecting an intention that various examples or embodiments of the present disclosure require more features than are expressly shown and/or recited in the claims. Further, additional examples herein may include fewer than all features described or illustrated.

While some examples described herein include some but not other features included in other examples (or embodiments), combinations of features of different examples and embodiments are included herein, as would be understood by those skilled in the art. For example, in the following claims, any of the claimed features can be used in any combination.

Furthermore, some of the examples are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus is an example of a means for carrying out the function performed by the element for the purpose of carrying out the principles herein.

While various examples of lighting devices and related methods have been described, those skilled in the art will recognize that other and further modifications may be made thereto without departing from the spirit of the present disclosure.

What is claimed is:

1. A lighting device comprising:

a housing including one or more end walls and one or more side walls, the housing defining a chamber and a base;

at least one solar panel;

at least one rechargeable battery in communication with the solar panel;

a microprocessor in communication with the solar panel and the rechargeable battery;

a plurality of lights disposed outside the chamber along an inner surface of the one or more side walls and configured to emit light in a direction transverse to the one or more side walls, the plurality of lights being in communication with the solar panel, the rechargeable battery, and the microprocessor; and a diffuser radially inward of the plurality of lights, the diffuser being configured to diffuse and redirect light emitted by the plurality of lights into the chamber;

wherein the microprocessor is configured to control at least one operating mode of the plurality of lights.

2. The lighting device of claim 1, further comprising a cover disposed between the chamber and the plurality of lights, the cover being opaque and defining a central opening that allows light generated by the plurality of lights to pass into the chamber.

3. The lighting device of claim 1, wherein the base encloses an electronic assembly that includes the rechargeable battery and the microprocessor, the electronic assembly further comprising a wireless interface configured to receive user input wirelessly from an external electronic device.

4. The lighting device of claim 1, wherein the diffuser defines a plurality of recesses along an outer periphery of the diffuser, and each light of the plurality of lights is accommodated within a respective recess of the plurality of recesses of the diffuser.

5. The lighting device of claim 1, wherein the housing has a cylindrical shape including a first end wall, a second end wall, a side wall, and an inner panel between the first end wall and the second end wall, wherein each of the first end wall, the second end wall, and the inner panel have a circular cross section.

6. The lighting device of claim 5, wherein the inner panel is a first inner panel, the lighting device further comprising a second inner panel between the first inner panel and the second end wall.

7. The lighting device of claim 1, wherein the one or more side walls includes a first side wall that defines the chamber, the first side wall being at least partially translucent.

8. The lighting device of claim 1, wherein the chamber is collapsible and inflatable, the chamber including a valve for inflating and deflating the chamber.

9. The lighting device of claim 1, wherein the base includes at least one user element configured to receive user input and transmit the input to the microprocessor.

10. The lighting device of claim 1, wherein the plurality of lights includes at least 6 lights comprising a plurality of white light-emitting diode (LED) lights and a plurality of RGB LED lights.

11. The lighting device of claim 10, wherein the at least one operating mode of the plurality of lights includes a first operating mode in which the white LED lights are turned on while the RGB LED lights are off, and a second operating mode in which the RGB LED lights are turned on while the white LED lights are off.

12. The lighting device of claim 11, wherein the white LED lights and the RGB LED lights are present in a ratio of two white LED lights for each RGB LED light.

13. The lighting device of claim 1, further comprising a handle coupled to the base and rotatable relative to the base about a pivot axis.

14. A lighting device comprising:

a housing including one or more end walls and one or more side walls, the housing defining a chamber and a base;

a plurality of RGB light-emitting diode (LED) lights disposed outside the chamber along an inner surface of the one or more side walls, the plurality of RGB LED lights being configured to emit light in a direction transverse to the one or more side walls;

a diffuser radially inward of the plurality of RGB LED lights to redirect light emitted by the plurality of RGB LED lights into the chamber; and an electronic assembly comprising:

at least one solar panel;

at least one rechargeable battery in communication with the solar panel;

a wireless interface configured to receive a user input wirelessly from an external electronic device; and a microprocessor in communication with the solar panel, the rechargeable battery, and the wireless interface, the microprocessor being configured to control at least one operating mode of the plurality of RGB LED lights based on the user input received from the external electronic device through the wireless interface, wherein the at least one operating mode includes changing a color of light that illuminates the chamber by selecting red, green, and blue values from 0 to 255 for each RGB LED light of the plurality of RGB LED lights.

15. The lighting device of claim 14, wherein the lighting device further comprises a plurality of white LED lights, and the at least one operating mode includes changing the color of light that illuminates the chamber by selecting red, green, and blue values from 0 to 255 for each RGB LED light while the white LED lights are off.

16. The lighting device of claim 14, wherein the diffuser defines a plurality of recesses along an outer periphery of the diffuser, and each RGB LED light of the plurality of RGB LED lights is accommodated within a respective recess of the plurality of recesses.

17. The lighting device of claim 14, wherein the plurality of RGB LED lights are coupled to a support and disposed at regular intervals along the support.

18. A lighting device comprising:

a cylindrical housing including two end walls and a side wall between the two end walls, the housing defining a chamber and a base;

a plurality of light-emitting diode (LED) lights disposed along an inner surface of the base and configured to emit light radially inward in a direction transverse to the side wall, the plurality of LED lights including white LED lights and RGB LED lights;

a diffuser radially inward of the plurality of LED lights, the diffuser being configured to diffuse light emitted by the plurality of LED lights into the chamber; and an electronic assembly comprising:

at least one solar panel;

at least one rechargeable battery in communication with the solar panel;

a wireless interface configured to receive user input wirelessly from an external electronic device; and a microprocessor in communication with the solar panel, the rechargeable battery, and the wireless interface;

wherein the microprocessor is configured to control at least one operating mode of the plurality of LED lights, including changing a color of light that illuminates the chamber by selecting red, green, and blue values from 0 to 255 for each RGB LED light of the plurality of lights.

19. The lighting device of claim 18, wherein the diffuser defines a plurality of recesses along an outer periphery of the diffuser, and each LED light of the plurality of LED lights is accommodated within a respective recess of the plurality of recesses.

* * * * *